US009355832B2

(12) United States Patent
Chiappetta et al.

(10) Patent No.: US 9,355,832 B2
(45) Date of Patent: May 31, 2016

(54) REFLECTRONS AND METHODS OF PRODUCING AND USING THEM

(71) Applicants: Anthony Chiappetta, Milford, CT (US); Urs Steiner, Branford, CT (US); Keith Ferrara, Stratford, CT (US)

(72) Inventors: Anthony Chiappetta, Milford, CT (US); Urs Steiner, Branford, CT (US); Keith Ferrara, Stratford, CT (US)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

(21) Appl. No.: 14/289,822

(22) Filed: May 29, 2014

(65) Prior Publication Data

US 2015/0028202 A1 Jan. 29, 2015

Related U.S. Application Data

(60) Provisional application No. 61/829,181, filed on May 30, 2013, provisional application No. 61/830,281, filed on Jun. 3, 2013.

(51) Int. Cl.
*H01J 49/06* (2006.01)
*H01J 49/40* (2006.01)

(52) U.S. Cl.
CPC ..... *H01J 49/067* (2013.01); *H01J 49/405* (2013.01)

(58) Field of Classification Search
USPC ..... 250/287, 282
See application file for complete search history.

(56) References Cited

U.S. PATENT DOCUMENTS

| | | | | |
|---|---|---|---|---|
| 3,342,993 | A | 12/1967 | Ohalloran | |
| 4,587,432 | A | 5/1986 | Aitken | |
| 5,559,327 | A | 9/1996 | Steiner | |
| 5,661,300 | A * | 8/1997 | Hansen et al. | 250/287 |
| 5,994,695 | A * | 11/1999 | Young | H01J 49/405 250/287 |
| 6,049,077 | A | 4/2000 | Franzen | |
| 6,107,625 | A * | 8/2000 | Park | H01J 49/406 250/282 |
| 6,107,628 | A | 8/2000 | Smith | |
| 6,177,668 | B1 | 1/2001 | Hager | |
| 6,465,777 | B1 | 10/2002 | Rache | |
| 6,528,784 | B1 | 3/2003 | Tang | |

(Continued)

FOREIGN PATENT DOCUMENTS

JP 2005-285543 10/2005

OTHER PUBLICATIONS

IPRP for PCT/US2014/039900 mailed on Apr. 6, 2015.

(Continued)

*Primary Examiner* — Phillip A Johnston
*Assistant Examiner* — Hsien Tsai
(74) *Attorney, Agent, or Firm* — Rhodes IP PLC; Christopher R Rhodes

(57) ABSTRACT

Certain embodiments described herein are directed to reflectron assemblies and methods of producing them. In some configurations, a reflectron comprising a plurality of lenses each comprising a planar body and comprising a plurality of separate and individual conductors spanning a central aperture from a first side to a second side of a first surface of the planar body is described. In some instances, the plurality of conductors are each substantially parallel to each other and are positioned in the same plane.

21 Claims, 19 Drawing Sheets

(56) References Cited

U.S. PATENT DOCUMENTS

| | | | | |
|---|---|---|---|---|
| 7,138,625 | B2 | 11/2006 | Overney | |
| 7,154,086 | B2 | 12/2006 | Laprade | |
| 2003/0071208 | A1 | 4/2003 | Hansen | |
| 2004/0036029 | A1 * | 2/2004 | Bertsch | H01J 49/40 250/396 R |
| 2004/0135080 | A1 | 7/2004 | Ouyang | |
| 2004/0169137 | A1 * | 9/2004 | Westphall et al. | 250/281 |
| 2006/0043283 | A1 | 3/2006 | Davis | |
| 2006/0091308 | A1 | 5/2006 | Boyle | |
| 2009/0321624 | A1 | 12/2009 | Fang | |
| 2013/0009051 | A1 | 1/2013 | Park | |

OTHER PUBLICATIONS

ISR/WO for PCT/US2014/040430 mailed on Jan. 13, 2015.
ISR/WO for PCT/US2014/040445 mailed on Jan. 12, 2015.
ISR/WO for PCT/US2014/040172 mailed on Dec. 10, 2014.

* cited by examiner

REFLECTRONS AND METHODS OF PRODUCING AND USING THEM

PRIORITY APPLICATIONS

This application is related to, and claims the benefit of, each of U.S. Provisional Application No. 61/829,181 filed on May 30, 2013 and U.S. Provisional Application No. 61/830,281 filed on Jun. 3, 2013, the entire disclosure of each of which is hereby incorporated herein by reference.

TECHNOLOGICAL FIELD

This application is related to mass spectrometry devices and methods of using them. More particularly, certain embodiments described herein are directed to reflectrons suitable for use in a mass spectrometer or other devices.

BACKGROUND

Mass spectrometry separates species based on differences in the mass-to-charge (m/z) ratios of the ions.

SUMMARY

Certain features, aspects and embodiments described herein are directed to devices, systems and methods that include a reflectron as described herein.

In one aspect, a reflectron comprising a plurality of lenses is provided. In certain embodiments, one or more lenses of the reflectron may comprise a plurality of separate and individual conductors that traverse an aperture in a planar body along the longitudinal axis from one side of the planar body to the other. In some embodiments, two or more lenses of the reflectron may comprise a plurality of separate and individual conductors that traverse the planar body of each lens along the longitudinal axis from one side of the planar body to the other. In other instances, the conductor may take the form of a single continuous wire that spans the aperture and runs from one side of the body to the other side of the body in a repeating manner. In certain embodiments, each of the lenses of the reflectron may be substantially parallel to each other.

In another aspect, a reflectron comprising a plurality of lenses is described. In certain examples, at least a first lens comprises a first planar body comprising a first surface and a second surface. In some examples, the first planar body comprises an aperture between a first side and a second side of the first surface of the first planar body. In certain embodiments, the first planar body further comprises a plurality of conductors, e.g., a plurality of separate and individual conductors, spanning the aperture from the first side to the second side of the first surface of the first planar body. In some instances, each of the plurality of conductors is attached to the first surface of the first planar body at the first side and at the second side of the first surface. In some examples, the plurality of conductors are each substantially parallel to each other and are positioned in the same plane. In other embodiments, the first planar body further comprises a conductive element disposed on the first surface of the first planar body and in contact with each of the plurality of conductors to permit current flow from the planar conductive body to the plurality of conductors. In some embodiments, the reflectron comprises a plurality of transverse rods, e.g., rods which are configured to run through or insert through the planar body, coupled to each of the plurality of lenses and effective to retain the plurality of lenses substantially parallel to each other.

In certain embodiments, at least two of the plurality of planar bodies of the plurality of lenses is configured the same as the first planar body. In other embodiments, the plurality of conductors do not contact the second surface of the planar body. In additional embodiments, the plurality of conductors are all positioned in the same plane. In some examples, each of the plurality of conductors comprises tungsten wires. In other embodiments, each of the plurality of conductors is the same material. In some embodiments, the plurality of conductors attach to the conductive element through a conductive adhesive. In other embodiments, the transverse rods are each ceramic rods. In additional embodiments, each planar body comprises a plurality of flexures configured to couple to one of the transverse rods. In further examples, the flexures couple to the transverse rods through a conductive adhesive. In other examples, the reflectron may comprise a conductive board electrically coupled to each of the plurality of lenses, in which the conductive board is configured to electrically couple to a power source to provide power to each of the plurality of lenses. In some embodiments, the conductive board comprises a resistor network to provide a differential voltage to each of the plurality of lenses. In other embodiments, the conductive board comprises a plurality of spring contacts, in which each lens of the plurality of lenses is electrically coupled to the conductive board through a single spring contact of the plurality of spring contacts. In further examples, the conductive board is coupled to the transverse rods through a fastener. In additional examples, the fastener comprises a clamp coupled to the rod and the conductive board. In some embodiments, the conductive board is configured as a printed circuit board. In some examples, the plurality of conductors do not contact the second surface of the planar body. In additional examples, the plurality of conductors are all positioned in the same plane. In further examples, the plurality of conductors attach to the conductive element through a conductive adhesive. In certain examples, each planar body comprises a plurality of flexures configured to couple to one of the transverse rods.

In an additional aspect, a reflectron comprising a plurality of lenses, in which at least one lens comprises a planar body comprising an aperture between a first side and a second side of the first surface of the planar body is provided. In some examples, the planar body further comprises a plurality of conductors, e.g., a plurality of separate and individual conductors, spanning the aperture from the first side to the second side of the first surface of the planar body. In other instances, each of the plurality of conductors is attached to the first surface of the planar body at the first side and at the second side of the first surface, in which the plurality of conductors are each substantially parallel to each other and are positioned in the same plane and in which the planar body comprises a plurality of rod apertures. In some embodiments, the reflectron comprises a plurality of transverse rods coupled to each of the plurality of planar bodies through the rod apertures, in which the transverse rods are configured to retain the plurality of lenses substantially parallel to each other.

In certain embodiments, the planar body of the at least one lens further comprises a conductive element disposed on the first surface of the planar body and in contact with each of the plurality of conductors to permit current flow from the planar conductive body to the plurality of conductors. In some embodiments, each of the plurality of lenses is configured the same. In additional embodiments, the plurality of conductors do not contact the second surface of the planar body. In some embodiments, each of the plurality of conductors comprises tungsten wires. In other embodiments, each of the plurality of conductors is the same material. In further embodiments, the plurality of conductors attach to the planar body through a conductive adhesive. In some embodiments, the transverse rods are each ceramic rods. In additional embodiments, the rod apertures of each planar body each comprise a flexure configured to couple to one of the transverse rods. In further embodiments, the flexures couple to the transverse rods through a conductive adhesive. In certain embodiments, the reflectron may further comprise a conductive board electrically coupled to each of the plurality of lenses, in which the conductive board is configured to electrically couple to a power source to provide power to each of the plurality of lenses. In other embodiments, the conductive board comprises a resistor network to provide a differential voltage to each of the plurality of lenses. In some embodiments, the conductive board comprises a plurality of spring contacts, in which each lens of the plurality of lenses is electrically coupled to the conductive board through a single spring contact of the plurality of spring contacts. In some examples, the conductive board is coupled to the transverse rods through a fastener. In other examples, the fastener comprises a clamp coupled to the rod and the conductive board. In additional examples, the conductive board is configured as a printed circuit board. In some embodiments, the plurality of conductors do not contact the second surface of the planar body. In certain examples, each planar body further comprises a plurality of separate and individual conductors on the second surface of the planar body. In other examples, the plurality of separate and individual conductors on the second surface attach to the planar body through a conductive adhesive. In certain embodiments, each of the plurality of separate and individual conductors on the first surface and the plurality of separate and individual conductors on the second surface each comprise conductive wires.

In another aspect, a lens comprising a planar conductive body comprising a first surface and a second surface, the planar body comprising an aperture between a first side and a second side of the first surface of the planar body, the planar body further comprising a plurality of conductors, e.g., a plurality of separate and individual conductors, spanning the aperture from the first side to the second side of the first surface of the planar body, each of the plurality of conductors attached to the planar body at the first side and at the second side of the first surface, in which the plurality of conductors are each substantially parallel to each other and are positioned in the same plane is described.

In certain embodiments, the lens comprises a first conductive element disposed on the first side of the first surface of the planar body and in contact with each of the plurality of conductors to permit current flow from the planar conductive body to the plurality of conductors. In certain examples, the plurality of conductors attach to the conductive element through a conductive adhesive. In other examples, the lens may further comprise a second conductive element disposed on the second side of the first surface of the planar body and in contact with each of the plurality of conductors to permit current flow from the planar conductive body to the plurality of conductors. In some examples, the plurality of conductors do not contact the second surface of the planar body. In additional examples, the plurality of conductors are all positioned in the same plane. In other embodiments, each of the plurality of conductors comprises tungsten wires. In some examples, each of the plurality of conductors is the same material. In certain examples, the lens may comprise a second conductive element disposed on the second side of the first surface of the planar body and in contact with each of the plurality of conductors to permit current flow from the planar conductive body to the plurality of conductors, in which the plurality of conductors attach to the first conductive element and the second conductive element through a conductive adhesive. In other embodiments, the planar body comprises a plurality of flexures each configured to couple to a transverse rod. In additional embodiments, the planar body comprises an alignment feature, e.g., a slot, groove, projection, etc., configured to permit insertion of the lens into a jig in a single orientation. In certain embodiments, the geometric shape of the planar body and the aperture is the same. In some embodiments, the geometric shape of the planar body and the aperture is the different. In certain examples, the plurality of conductors are positioned substantially parallel to a longitudinal axis of the planar body. In additional examples, the plurality of conductors are positioned substantially orthogonal to a longitudinal axis of the planar body. In further examples, the lens may comprise a plurality of separate and individual conductors on the second surface of the planar body. In some embodiments, the plurality of separate and individual conductors on the second surface of the planar body are positioned orthogonal to the plurality of separate and individual conductors on the first surface of the planar body. In certain examples, the plurality of separate and individual conductors on the first surface and the plurality of separate and individual conductors on the second surface comprise different materials. In certain embodiments, the plurality of separate and individual conductors on the second surface attach to the planar body through a conductive adhesive. In certain examples, each of the plurality of separate and individual conductors on the first surface and the plurality of separate and individual conductors on the second surface comprise conductive wires.

In an additional aspect, a lens comprising a planar body comprising an aperture between a first side and a second side of the first surface of the planar body, the planar body further comprising a plurality of conductors, e.g., a plurality of separate and individual conductors spanning the aperture from the first side to the second side of the first surface of the planar body, each of the plurality of conductors attached to the first surface of the planar body at the first side and at the second side of the first surface, in which the plurality of conductors are each substantially parallel to each other and are positioned in the same plane, in which the planar body comprises a plurality of rod apertures is provided.

In certain embodiments, the lens may comprise a first conductive element disposed on the first side of the first surface of the planar body and in contact with each of the plurality of conductors to permit current flow from the planar conductive body to the plurality of conductors. In other embodiments, the plurality of conductors attach to the conductive element through a conductive adhesive. In some embodiments, the lens may comprise a second conductive element disposed on the second side of the first surface of the planar body and in contact with each of the plurality of conductors to permit current flow from the planar conductive body to the plurality of conductors. In certain examples, the plurality of conductors do not contact the second surface of the planar body. In additional examples, the plurality of conductors are all positioned in the same plane. In other examples, each of the plurality of conductors comprises tungsten wires. In some embodiments, each of the plurality of conductors is the same material. In certain examples, the lens may comprise a second conductive element disposed on the second side of the first surface of the planar body and in contact with each of the plurality of conductors to permit current flow from the planar conductive body to the plurality of conductors, in which the plurality of conductors attach to the first conductive element and the second conductive element through a conductive adhesive. In some examples, the rod apertures of the planar body comprise a flexure configured to couple to a transverse rod. In certain embodiments, the planar body comprises an alignment feature configured to permit insertion of the lens into a jig in a single orientation. In certain examples, the geometric shape of the planar body and the aperture is the same. In some examples, the geometric shape of the planar body and the aperture is the different. In other examples, the plurality of conductors are positioned substantially parallel to a longitudinal axis of the planar body. In some embodiments, the plurality of conductors are positioned substantially orthogonal to a longitudinal axis of the planar body. In certain examples, the lens may comprise a plurality of separate and individual conductors on the second surface of the planar body. In some embodiments, the plurality of separate and individual conductors on the second surface of the planar body are positioned orthogonal to the plurality of separate and individual conductors on the first surface of the planar body. In certain examples, the plurality of separate and individual conductors on the first surface and the plurality of separate and individual conductors on the second surface comprise different materials. In some examples, the plurality of separate and individual conductors on the second surface attach to the planar body through a conductive adhesive. In other embodiments, each of the plurality of separate and individual conductors on the first surface and the plurality of separate and individual conductors on the second surface comprise conductive wires.

In another aspect, a kit comprising a lens and a jig comprising a plurality of slots each configured to receive a single lens and align the lens substantially parallel to other lenses in the jig is disclosed. In some examples, the lens comprises a planar conductive body comprising a first surface and a second surface, the planar body comprising an aperture between a first side and a second side of the first surface of the planar body, the planar body further comprising a plurality of conductors, e.g., a plurality of separate and individual conductors, spanning the aperture from the first side to the second side of the first surface of the planar body, each of the plurality of conductors attached to the planar body at the first side and at the second side of the first surface, in which the plurality of conductors are each substantially parallel to each other and are positioned in the same plane.

In certain embodiments, the kit comprises instructions for using the lens and the jig to assemble a reflectron. In other embodiments, the kit comprises at least one additional lens comprising a planar conductive body comprising a first surface and a second surface, the planar body comprising an aperture between a first side and a second side of the first surface of the planar body, the planar body further comprising a plurality of conductors spanning the aperture from the first side to the second side of the first surface of the planar body, each of the plurality of conductors attached to the planar body at the first side and at the second side of the first surface, in which the plurality of conductors are each substantially parallel to each other and are positioned in the same plane. In some examples, the kit comprises a rod configured to couple to a rod aperture in the planar body of the lens. In further examples, the kit comprises a conductive adhesive. In additional examples, the kit comprises a plurality of lenses comprising at least one additional lens comprising a planar conductive body comprising a first surface and a second surface, the planar body comprising an aperture between a first side and a second side of the first surface of the planar body, the planar body further comprising a plurality of conductors spanning the aperture from the first side to the second side of the first surface of the planar body, each of the plurality of conductors attached to the planar body at the first side and at the second side of the first surface, in which the plurality of conductors are each substantially parallel to each other and are positioned in the same plane, and a plurality of transverse rods each configured to couple to a rod aperture in the planar body of the lens. In some embodiments, the kit comprises a conductive adhesive. In certain embodiments, the kit comprises instructions for using the plurality of lenses, the plurality of transverse rods and the jig to assemble a reflectron. In certain examples, the kit comprises a printed circuit board comprising a plurality of spring contacts, in which each spring contacts are sized and arranged to contact an edge of a single lens of a reflectron assembly when the printed circuit board is coupled to the reflectron assembly. In other examples, the kit comprises a clamp configured to couple to a transverse rod and to the printed circuit board to couple the printed circuit board to the reflectron assembly.

In an additional aspect, a method of assembling a reflectron comprising inserting a plurality of ion lenses into an assembly jig comprising a plurality of slots each sized and arranged to receive a single ion lens and position the ion lens substantially parallel to each other, inserting at least one transverse rod through rod apertures in each of the inserted ion lenses in the assembly jig, and coupling the inserted transverse rod to each of the inserted ion lenses is provided.

In certain embodiments, the coupling step comprises coupling the transverse rod to each lens using a conductive adhesive. In other embodiments, the method comprises removing the coupled transverse rod and plurality of ions lenses from the assembly jig. In additional embodiments, the method comprises inserting a respective transverse rod through each rod aperture of the ion lenses to couple the rods to the ion lenses. In some examples, the coupling step comprises coupling each transverse rod to each lens using a conductive adhesive. In other examples, the method comprises coupling a conductive board to the coupled lens/rod assembly. In further examples, the method comprises coupling the conductive board comprises clamping the conductive board to at least one transverse rod. In some embodiments, the step of the coupling the conductive board comprises clamping the conductive board to a transverse rod at two different sites. In other embodiments, the step of the coupling the conductive board comprises clamping the conductive board to at least two different transverse rods.

Additional features, aspect, examples and embodiments are described in more detail below.

BRIEF DESCRIPTION OF THE FIGURES

Certain embodiments of the devices and systems are described with reference to the accompanying figures in which.

Figure 1:
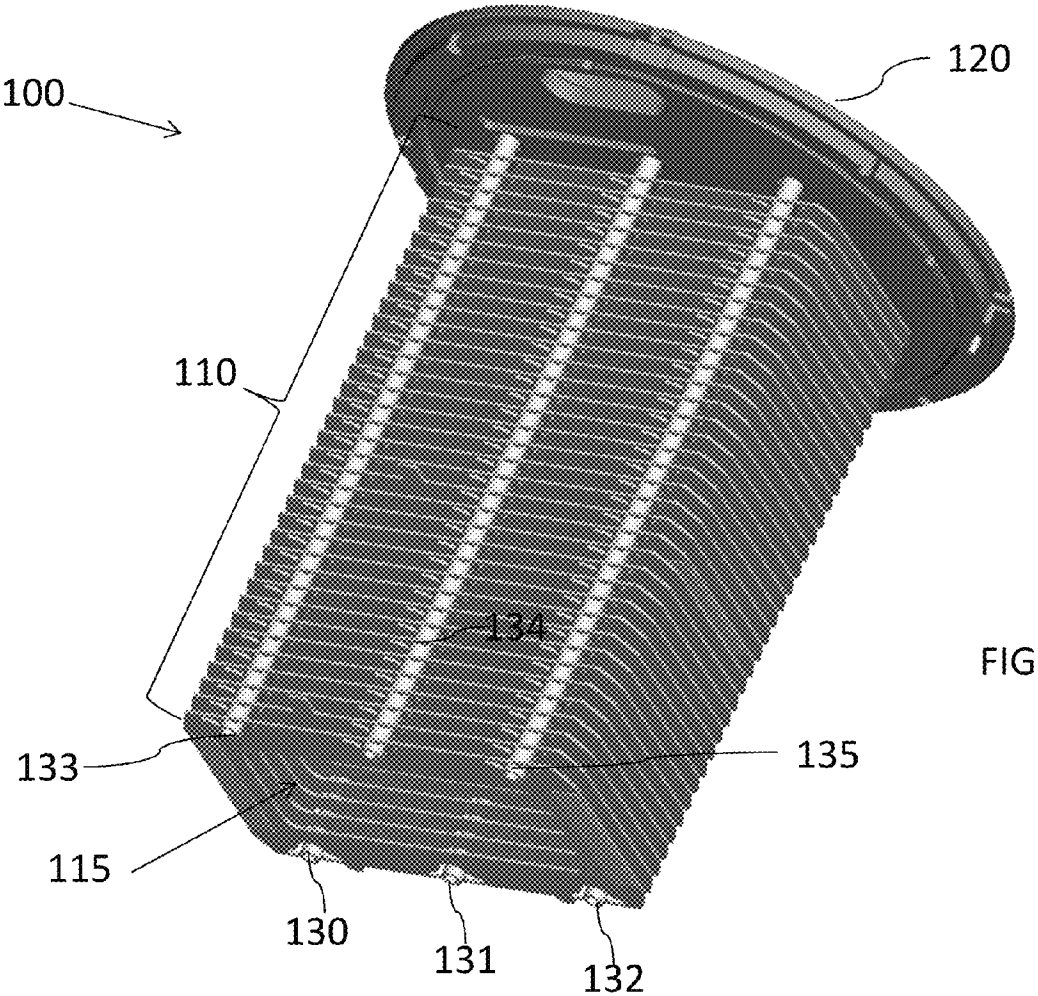
FIG. 1 is perspective view of a reflectron assembly, in accordance with certain examples.

It will be recognized by the person of ordinary skill in the art, given the benefit of this disclosure, that certain dimensions or features of the components of the systems may have been enlarged, distorted or shown in an otherwise unconventional or non-proportional manner to provide a more user friendly version of the figures.

In addition, while the geometry of the planar bodies, apertures and the like are shown herein as being generally rectangular, other geometric shapes for the bodies and/or apertures, e.g., circular, may also be used.

DETAILED DESCRIPTION

Certain embodiments are described below with reference to singular and plural terms in order to provide a user friendly description of the technology disclosed herein. These terms are used for convenience purposes only and are not intended to limit the devices, methods and systems described herein.

In certain instances, the reflectrons described herein may be low cost and light weight reflectrons for cost sensitive time of flight mass spectrometers. In current designs the fixturing is built into the assembly, leading to extra cost as each component must be manufactured very precisely. For example, existing reflectrons may include outer fixtures that are machined to tight tolerances to properly align the ion grids. To provide the proper alignment, the fixtures are produced at high cost. In embodiments described herein, cheaper individual components can be utilized and assembled in a precise way to reduce overall cost of the reflectron while still providing desired reflectron performance. As described in more detail below, embodiments of the reflectrons may comprise a plurality of lenses each comprising planar conductive bodies and transverse rods coupled to the planar conductive bodies. In some instances, conductors may span from one side of the planar body to the other to provide a lens suitable for use in time of flight measurements. As described in more detail herein, the various lenses of the reflectron may be substantially parallel, e.g., may include a parallelism of less than 0.005 inches, for example. Additional features, configurations and components are described in more detail below. In other aspects, the reflectrons described herein can be configured as single-stage reflectrons, double-stage reflectrons or other configurations may be implemented.

In certain embodiments, the devices, systems and methods described herein can be used in a time of flight mass spectrometer to detect species based on mass-to-charge ratios. In general and without wishing to be bound by any particular scientific theory, time-of-flight mass spectrometry is a method where an ion's mass-to-charge ratio is determined by a time measurement as an ion is released into a time of flight tube and arrival of the ion at the detector. Ions are accelerated by an electric field of known or selected strength. This acceleration results in an ion having the same kinetic energy as any other ion that has the same charge. The velocity of the ion depends on the mass-to-charge ratio. An ion can be pulsed or released into the time of flight tube at a known time, and the time that it subsequently takes for the particle to arrive a detector at a known distance is detected. This time will depend, at least in part, on the mass-to-charge ratio of the particle (heavier particles generally reach lower speeds). From the measured time and the known experimental parameters, it is possible to determine the mass-to-charge ratio of the ion.

In certain embodiments, the reflectrons described herein may include a plurality of lenses each comprising a planar body. In some instances, one, two, three or more lenses may include conductors that span an aperture of the lens as described herein, whereas in other examples, all lenses of the reflectron may be open and not include spanning conductors. In certain embodiments, the reflectrons described herein can include a plurality of individual conductive lenses or plates comprising planar bodies as shown, for example, in FIG. 1. The reflectron 100 comprises a plurality of lenses 110 that are positioned substantially parallel to each other in the assembly. A mounting surface 120 is present to attach the overall reflectron assembly to other components and permits insertion of the reflectron assembly 100 in a time of flight tube (not shown). The first lens is generally fluidically coupled to, or placed in, a time of flight tube such that the reflectron 100 can receive ions from a pulser or other device fluidically coupled to the time of flight tube. Without wishing to be bound by any particular scientific theory, differential voltages applied to the planar lens stack 110 provide an electric field reflecting the ions back to the bottom of the flight tube. The terminal lens, e.g., the one closest to the mounting surface 120, typically does not include an aperture, such as the aperture 115, but is instead a generally solid charged body effective to direct any ions back down the lens stack 110 and to the detector (not shown). In operation, as ions enter into the reflectron 100 through the aperture 115, their direction of travel is initially toward the mounting surface 120. At some point in the reflectron, the flight of the ion is reversed, e.g., reflected, and the ions exit through the aperture 115 and arrive at the detector. Ions formed in the ion source can obtain a kinetic energy less than or equal to the potential applied to the ion source. If the potential energy of the reflectron is greater than the ion source potential, ions that enter the reflectron 100 travel to a point that is substantially similar to the energy obtained from the ion source. The ions then stop and return back down the reflectron. In certain embodiments, the reflectron can increase the length of the flight path, which increases flight time and permits a larger temporal distribution between ions of similar m/z. In other embodiments, the reflectron can provide temporal focusing that can be exploited to reduce the arrival time distribution at the detector. The combination of greater flight time and greater time between the arrival of ions with similar m/z ratios and a reduction in the arrival time distribution can provide a resolution enhancement. A detector can be positioned on the entrance side of the reflectron to capture the arrival of ions after they are reflected. Common methods of positioning the detector include, but are not limited to, co-axial with the initial direction of the ion beam or off-axis with respect to the initial direction of the ion beam.

Figure 2A:
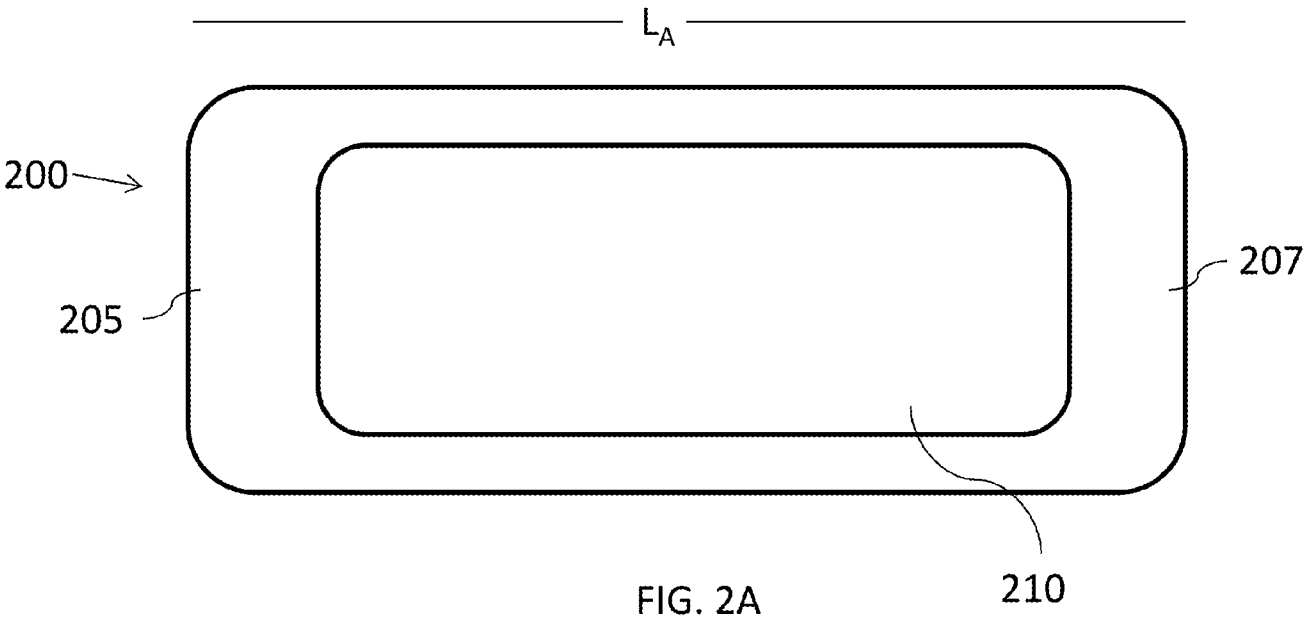
FIG. 2A a top view of a planar body of a lens suitable for use in a reflectron assembly, in accordance with certain examples.
Figure 2B:
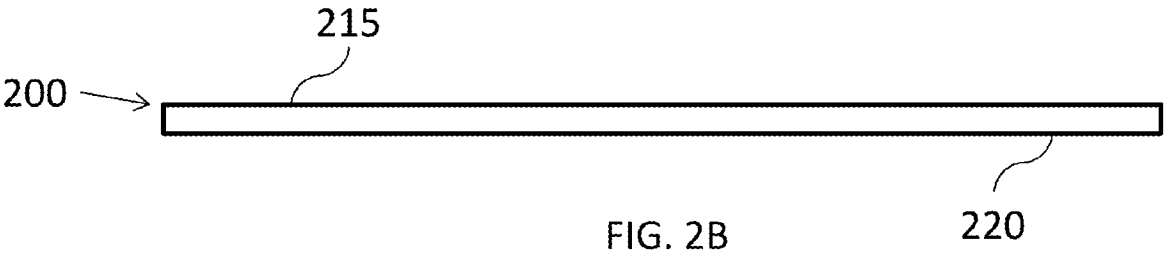
FIG. 2B is a side view of the planar body of FIG. 2A, in accordance with certain examples.

In certain embodiments, each of the lenses of the reflectron may comprise a generally planar body with a first surface and a second surface. The exact geometry of the planar body and/or aperture of the planar body can vary. Referring to FIGS. 2A and 2B, a conductive planar body 200 with a first surface 215 and a second surface 220, sides 205, 207 on the first surface 215 and an aperture 210 is shown. While not shown in FIGS. 2A and 2B, if desired, the sides of the planar body may include one or more alignment features, e.g., grooves, projections or slots, to act as guides for the planar bodies during assembly of the lenses into a lens stack of the reflectron.

In certain examples, one or more of the planar bodies in the lens stack may include one or more conductors. For example, a plurality of conductors may span the aperture from 210 the first side 205 to the second side 207 of the body 200. In some examples, the conductors are separate and individual conductors that do not physically contact each other. In other embodiments, the conductor may be a single continuous wire that runs from the surface 205 to the surface 207 and then back to the surface 205. The continuous wire may be welded, adhered or otherwise attached to the sides 205, 207. Where individual conductors or a continuous wire are used, the various runs across the planar body are desirably substantially parallel to each other. As described in more detail below, the conductors generally contact the sides 205, 207 either directly or through the use of a conductive element or pad (not shown) such that current may flow from the planar body 200 and into the conductors to provide an ion grid. For example, the conductors may be electrically coupled and physically coupled to the sides 205, 207 through a conductive adhesive, weld or other suitable attachment means to permit current to flow from the body 200 to the conductors and to generally hold the conductors in place during operation of the reflectron. Contact of the conductors with the conductive element, or with the planar body in the case where a conductive element is omitted, charges each of the conductors with the same polarity, e.g., all conductors have a similar charge and/or voltage.

Figure 3A:
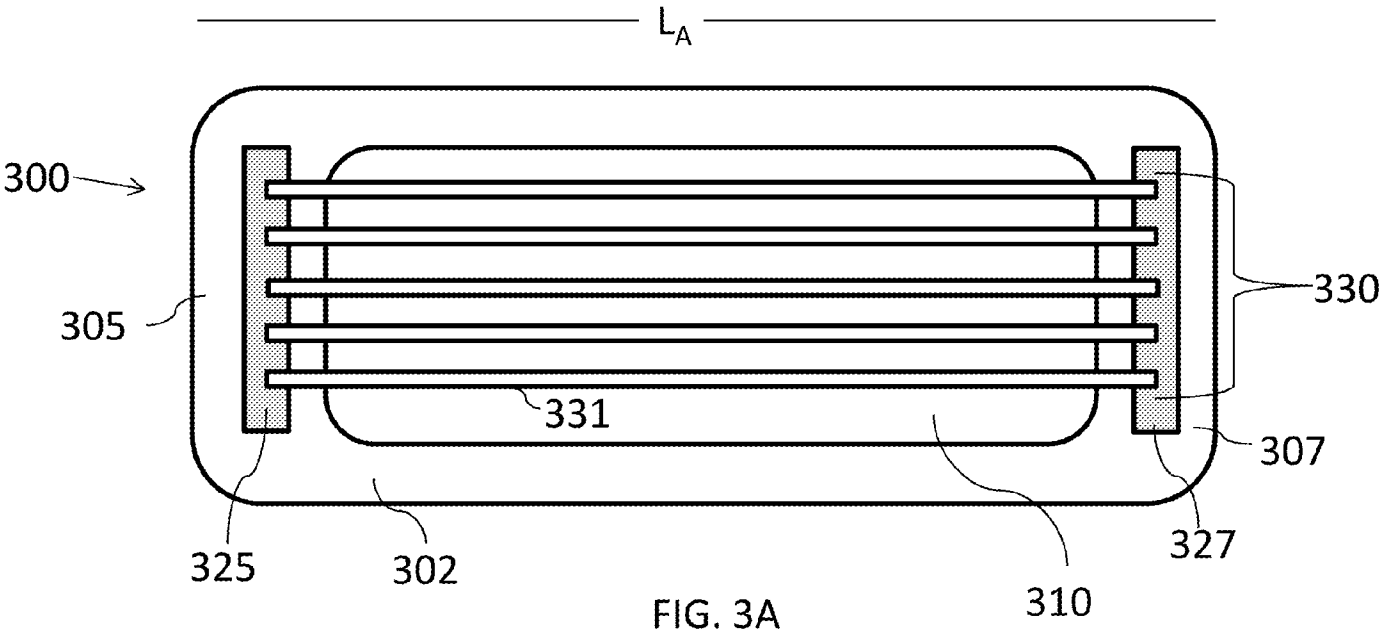
FIG. 3A a top view of a lens comprising a plurality of individual conductors positioned across the aperture of a planar body in a direction substantially parallel to the longitudinal axis of the planar body, in accordance with certain examples.
Figure 3B:
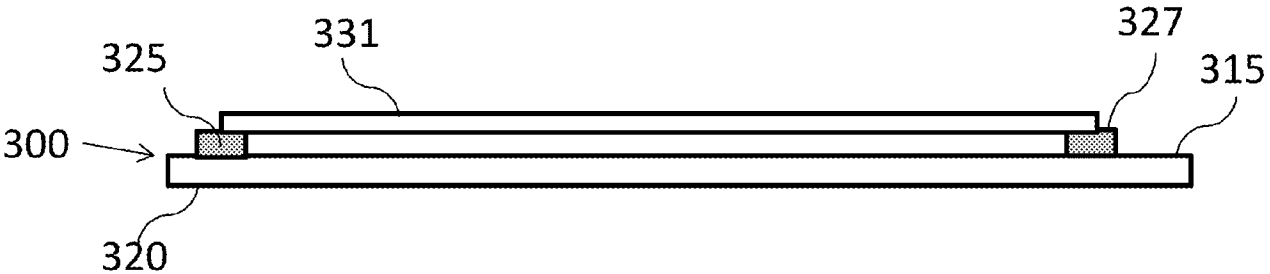
FIG. 3B is a side view of the lens of FIG. 3A, in accordance with certain examples.

In certain embodiments, one illustration of a lens comprising conductors is shown in FIGS. 3A and 3B with the conductors greatly enlarged for ease of description. The spacing between the conductors has also been enlarged for ease of description. The lens 300 comprises a planar body 302 comprising sides 305, 307, an aperture 310, a first surface 315 and a second surface 320. A plurality of individual and separate conductors 330 spans the aperture 310 in a direction substantially parallel to the longitudinal axis $L_A$ of the lens 300. As shown in the exaggerated bottom view of FIG. 3B, one of the conductors 331 sits above the first surface 315 and is in contact with conductive elements 325 and 327. In some embodiments, each of the plurality of conductors 330 is arranged in substantially the same plane above the first surface 315 of the body 300. By arranging the conductors in substantially the same plane, a more uniform electric field can be provided. In some configurations, no conductors are present on the second surface 320 of the planar body 300, whereas in other configurations, conductors may be present on the second surface 320 that are substantially parallel and underneath a corresponding wire on the first surface 315. In other configurations, no transverse conductors, e.g., no conductors positioned substantially orthogonal to the plurality of conductors 330 are present. In operation of the planar lens 300, a power source and the planar body 300 are electrically coupled to each other through a suitable contact, and current may flow from the power source to the planar body 300 and through the conductive elements 325, 327 and to the plurality of conductors 330 to provide a charged ion grid. Each of the plurality of conductors 300 comprise individual and separate conductors which generally do not contact the other conductors and are spaced suitably from the other conductors. In some instances, each of the conductors of the plurality of conductors 330 is substantially parallel to the other conductors of the plurality of conductors 330.

Figure 3C:
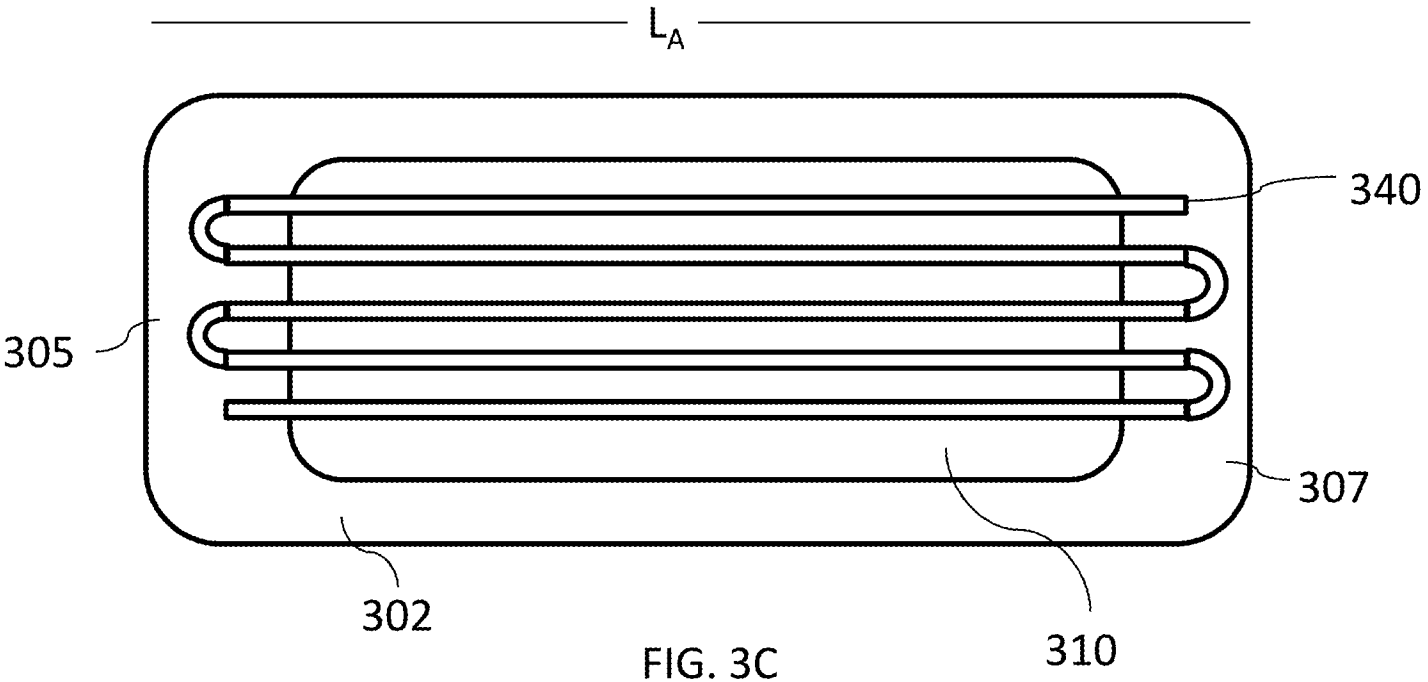
FIG. 3C is a view of a lens comprising a single continuous conductor, in accordance with certain examples.

In some examples, instead of including a plurality of separate and individual conductors that span the aperture 310, a single continuous conductor may be present as shown in FIG. 3C. The conductor 340 may run from the first side 305 to the second side 307 on the first surface and then back to the first side 305. This arrangement may repeat a desired number of times across the aperture 310. If desired, the turns of the conductors may be removed prior to use of the lens or may remain in place. In some embodiments, the turns may be electrically coupled to a conductive element(s) (not shown) similar to the conductive elements 325 and 327.

Figure 4A:
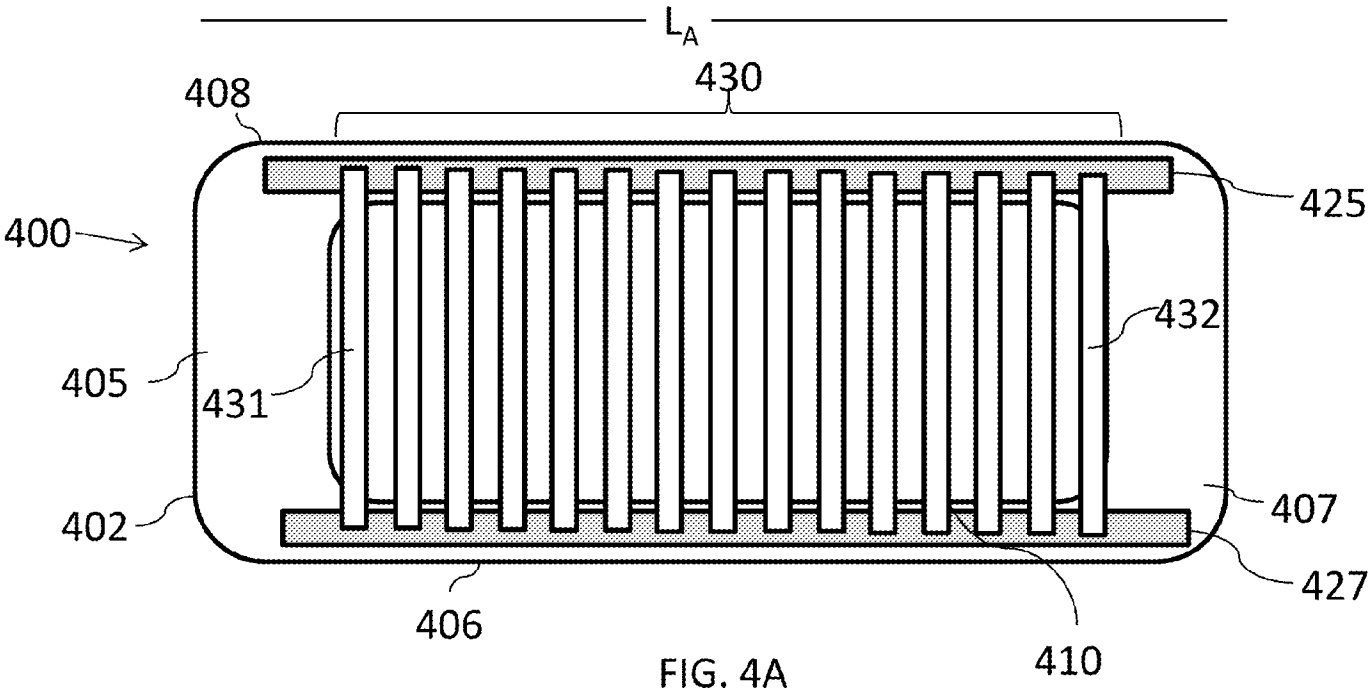
FIG. 4A a top view of a lens comprising a plurality of individual conductors positioned across the aperture of a planar body in a direction substantially orthogonal to the longitudinal axis of the planar body, in accordance with certain examples.
Figure 4B:
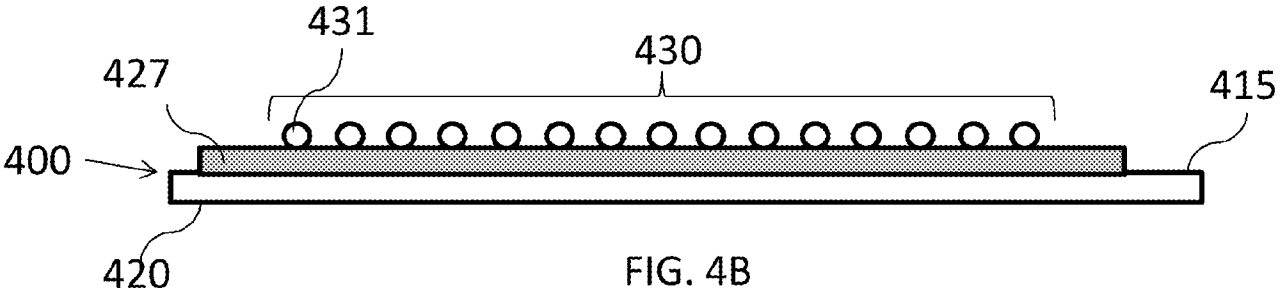
FIG. 4B is a side view of the lens of FIG. 4A, in accordance with certain examples.

In other embodiments, the conductors of the lenses may be substantially orthogonal to the longitudinal axis of the planar body and substantially parallel to each other. For example and referring to FIGS. 4A and 4B, a lens 400 comprises a generally planar body 402 comprising sides 405, 406, 407, and 408, an aperture 410, a first surface 415 and a second surface 420. A plurality of conductors 430 spans the aperture 410 in a direction substantially orthogonal to the longitudinal axis $L_A$ of the body 400. Each of the plurality of conductors 430 is positioned above the first surface 415 and is in contact with conductive elements 425 and 427. In some embodiments, each of the plurality of conductors 430 is arranged in substantially the same plane above the first surface 415 of the body 400, as shown in the bottom view of FIG. 4B. In certain examples, no conductors are present on the second surface 420 of the planar body 400. In other configurations, no longitudinal conductors, e.g., no conductors positioned substantially parallel to the longitudinal axis $L_A$, are present on the lens 400. In operation of the lens 400, a power source and the planar body 400 are electrically coupled to each other through a suitable contact, and current may flow from the power source to the planar body 400 and through the conductive elements 425, 427 and to the plurality of conductors 430 to provide a charged ion grid. Each of the plurality of conductors 430 comprise separate and individual conductors which generally do not contact the other conductors and are spaced suitably from the other conductors. In certain embodiments, each of the conductors of the plurality of conductors 430 is substantially parallel to the other conductors of the plurality of conductors 430.

Figure 5C:
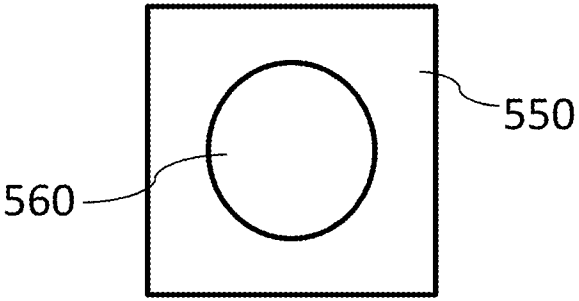
FIGS. 5A-5D are illustrations of planar bodies comprising various geometric shapes, in accordance with certain examples.
Figure 5D:
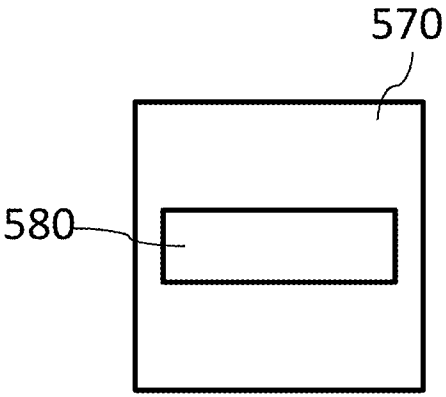
Figure 5A:
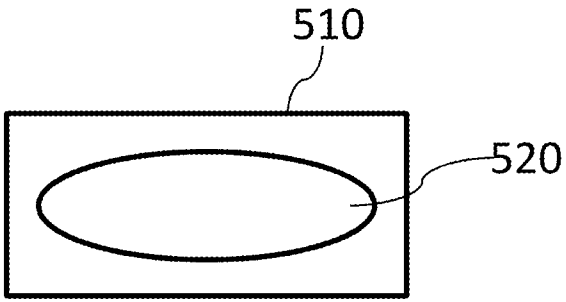
Figure 5B:
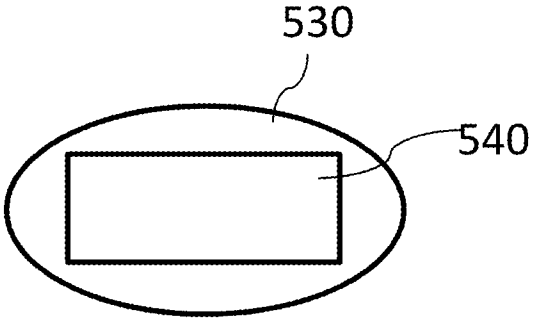

In certain embodiments, the planar bodies of the lenses described herein may be configured with many different geometries. The geometries shown in FIGS. 2A-4B comprise generally rectangular planar bodies with generally rectangular apertures. In other configurations, the cross-sectional geometric shape of the aperture need not be the same as the cross-sectional shape of the planar body. For example and referring to FIG. 5A, a planar body 510 may comprise a generally rectangular shape with an aperture 520 comprising an oval or elliptical shape. In other examples and referring to FIG. 5B, a planar body 530 may generally comprise an oval or elliptical shape with an aperture 540 comprising a generally rectangular shape. In some embodiments and referring to FIG. 5C, a planar body 550 may comprise a generally square shape with an aperture 560 comprising a circular shape. In additional configurations and referring to FIG. 5D, a planar body 570 may comprise a generally square shape with an aperture 580 comprising a generally rectangular shape. While not shown in FIGS. 5A-5D, the planar bodies may comprise one or more conductive elements at one or more sides, may comprise a plurality of individual conductors which span the apertures from one side to the other and may also comprise additional features as described herein. While no particular geometry is required for the planar bodies and the apertures, the size of the aperture is desirably large enough to permit the ions to enter into the reflectron and reverse their path and be incident on the detector without contacting the planar bodies.

In certain examples, the planar bodies present in the reflectrons may be laser cut, or cut using other methods, from thin conductive sheets of material to permit rapid and low-cost production of the planar bodies. For example, large sheets of material may be used to provide a plurality of individual planar bodies suitable for use in producing a lens as described herein. While the exact dimensions of the planar bodies may vary depending on the reflectron construction, in some examples, the planar body is about 0.01 inches to about 0.04 inches thick, e.g., about 0.02-0.04 inches. Where the planar body takes the form similar to that shown in FIGS. 2A and 2B, the planar body may be about 2 inches wide to about 5 inches wide, more particularly about 2.5 inches wide to about 4 inches wide, e.g., about 2.75-3 inches wide, by about 4 inches long to about 7 inches long, more particularly about 4.5 inches long to about 6 inches long, e.g., about 5.1-5.5 inches long. The aperture of the planar body may be about 1 inch wide to about 4 inches wide, more particularly about 1.25 inches wide to about 3 inches wide, e.g., about 1.5-1.6 inches wide, by about 3 inches long to about 6 inches long, more particularly about 3.5 inches long to about 5 inches long, e.g., about 3.8-4 inches long. In some examples, the material used in the planar body may be any suitable materials including conductive materials, or where a non-conductive material is present, a conductive coating may be applied, if desired, to the surfaces of the planar body. In some instances, the material of the planar body may be stainless steel, Inconel® alloys, Hastelloy® alloys, aluminum or aluminum alloys, copper or copper alloys, titanium or titanium alloys, ceramics, rigid plastics with a conductive coating or with conductive particles embedded or disposed in the plastics or other suitable materials that are conductive and generally inert under the operating conditions of the reflectron may be used. Where a conductive coating is present, the coating may comprise many different types of conductive materials or particles including, but not limited to, copper, gold, silver, combinations of these metals or other metals or conductive materials. If desired, the coating may be provided using nanoparticles, nanostructures or nanomaterials. The coating may be vapor deposited, brushed on, sprayed on or otherwise added to the planar body. The coatings may be cured, sintered or otherwise processed in a desired manner to reduce the likelihood that the coatings will flake off or be removed during operation of the reflectron.

In some embodiments, the lenses present in the reflectron may each comprise the same material such that a plurality of identical planar bodies are present in the reflectron. In other configurations, it may be desirable to use planar bodies of different materials to provide a desired result. For example, as discussed below, the planar bodies of the reflectrons are electrically coupled to a conductive plate or board comprising a resistor ladder to alter the voltage applied to each of the planar bodies. To control the differential voltage further, it may be desirable to use planar bodies of different material compositions at different positions along the lens stack of the reflectron. In other instances, the thickness of different planar bodies in the reflectron may be different if desired, or the thickness of each planar body may be the same. Similarly, the geometric shape of different planar bodies may be different, e.g., the overall shape of the plate may be different or the aperture of the plate may be different from that of other plates present in the reflectron. In some instances, each of the plates of the reflectron may comprise the same overall geometric shape, the same geometric shape for the aperture and/or the same materials.

In certain embodiments, the conductors coupled to the planar bodies may take many forms and shapes including circular wires, square wires or wires of other forms. In some examples, the wires may be stretched from one side of the planar body to the other and span the apertures. As discussed herein, each of the conductors can be substantially parallel to other conductors coupled to the planar body. The exact number of conductors present, and their spacing, can vary. In some embodiments, the conductors may be present with substantially equal conductor-to-conductor spacing, whereas in other embodiments it may be desirable to vary the conductor spacing. Illustrative conductor spacing where the conductors take the form of wires includes, but is not limited to, 0.001 inches to about 0.005 inches, more particularly about 0.001 inches to about 0.004 inches, for example, about 0.002 inches to about 0.0004 inches or about 0.003 inches. To obtain such close spacing, the conductors may be disposed across a first surface of the planar body and then wrapped around a second surface of the planar body. In some instances, the planar body of the lens may include slots or grooves on the edges to guide the position of the conductors during assembly. A second conductor can be disposed adjacent to the disposed first wire in a similar manner. After the conductors are coupled to the first surface, the conductors present or adjacent to the second surface may be cut away or otherwise removed from the planar body. In other instances individual wires can be disposed on the first surface and coupled to the first surface through the conductive elements as described herein optionally with a conductive adhesive or other similar materials. In other embodiments, a template may be overlaid onto the planar body and conductive materials may be sprayed into, or disposed or deposited into, openings of the template to form the conductors which span the apertures of the planar bodies. For example, a template may include a front plate comprising a plurality of slots and a back plate that provides a support surface configured to mate to the front plate. Depositing of materials into the slots of the front plate and removal of the template post deposition and/or post curing can leave behind a plurality of individual conductors which are substantially parallel to each other and which span the aperture of the planar body.

In certain examples, the overall cross-sectional diameter of the conductors may vary, for example, from about 0.001 inches to about 0.003 inches, more particularly about 0.001 inches to about 0.002 inches, e.g., about 0.0025 inches. In some instances, the diameter of the conductors on a particular planar body may be the same, whereas in other examples, different conductors on a particular lens may comprise a different diameter. In other configurations, all conductors of a particular lens may be the substantially the same diameter, but conductors on a second lens may have a diameter which is different than the diameter of the conductors on the first lens. In alternative configurations, the conductors on one lens may be sized similar to the conductors on a second lens, but the materials present in the conductors on the two lenses may be different. Other configurations using different conductor materials and/or sizes on different planar bodies will be readily selected by the person of ordinary skill in the art, given the benefit of this disclosure. In some configurations, about 70 individual conductors to about 90 individual conductors, e.g., about 80 conductors, may be present on each of the planar bodies and may span the aperture of the planar bodies. In certain instances, the length of each conductor may vary from about 3.5 inches to about 6 inches, for example about 4 inches to about 5.5 inches. Different plates may have different numbers of wires. The exact material present in the conductors may vary and illustrative materials include, but are not limited to, tungsten, gold, silver, copper, alloys thereof or other conductive materials which may be present in a coating, wire or in other configurations.

Figure 6:
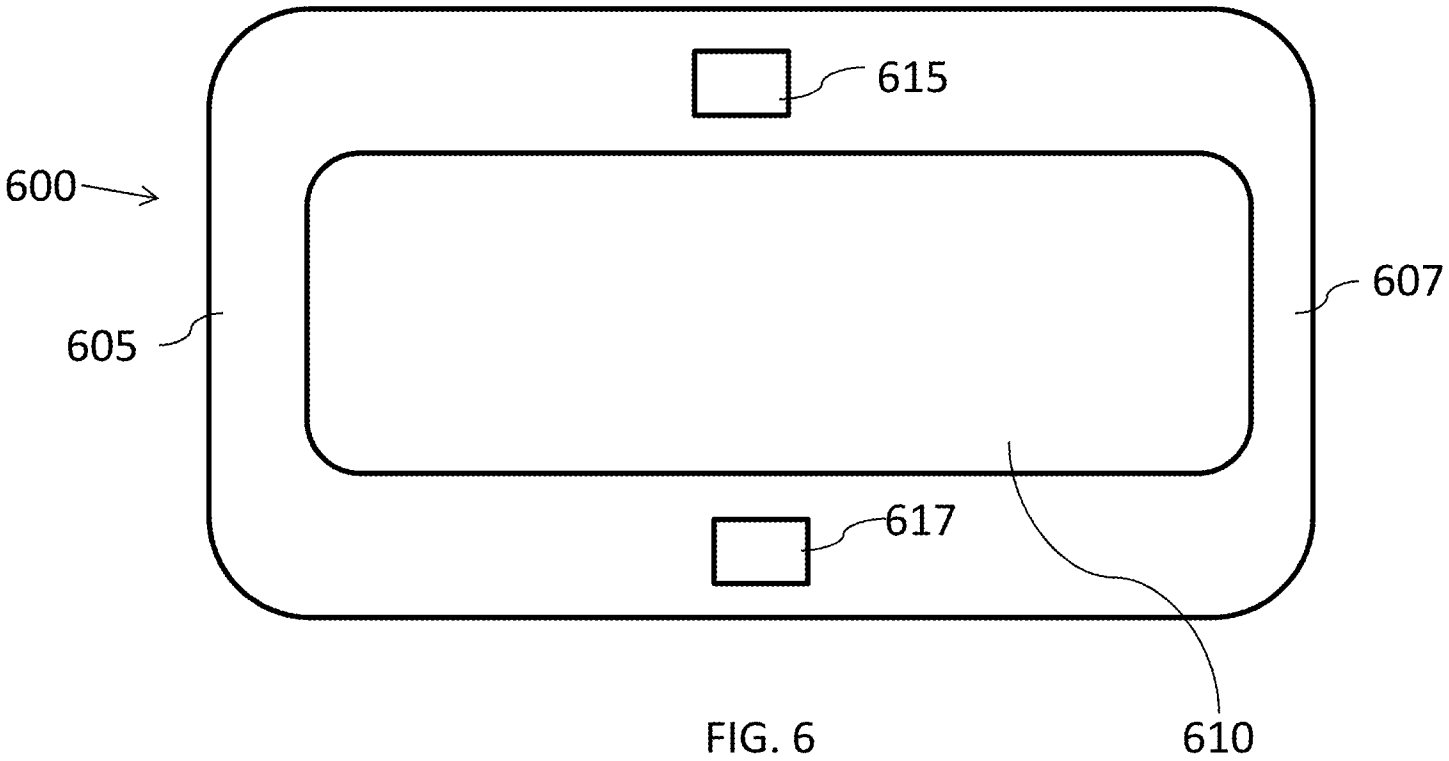
FIG. 6 is an illustration of a planar body comprising two rod apertures, in accordance with certain examples.

In certain embodiments, the planar bodies of the lenses present in the reflectrons described herein may include one or more rod apertures that are sized and arranged to receive one or more transverse or support rods, e.g., see, for example, rods 130-135 in FIG. 1, configured to retain and/or align the various lenses of the reflectrons. For example, a planar body without any conductors may comprise a rod aperture, or a planar body with conductors may comprise a rod aperture. In some instances, all the lenses in a lens stack may comprise similarly shaped rod apertures but only certain lenses in the stack, e.g., one, two or three lenses, may comprise conductors or wires as described herein. The exact number of rod apertures that are present can vary, for example, from two to ten, more particularly, two to eight or four, five or six rod apertures may be present in each planar body. Referring to FIG. 6, a planar body 600 is shown comprising sides 605, 607, an aperture 610 and rod apertures 615 and 617. The planar body 600 would typically comprise a plurality of conductors spanning the aperture 610, but these components have been intentionally omitted from FIG. 6 for ease of illustration. In assembly of the reflectron, a rod can be inserted into each of the apertures 615 and 617 to retain the various planar bodies in the assembly. In some instances, the rods may be attached to each planar body using an adhesive, welding, melting or other suitable attachment methods. As discussed in more detail below, during assembly of the reflectron, a plurality of individual planar bodies may be inserted into an assembly jig comprising a plurality of slots each configured to receive a single planar body. A rod can then be inserted through the rod apertures and coupled to each planar body to retain the planar bodies in a substantially parallel configuration relative to the other planar bodies of the reflectron assembly.

Figure 7:
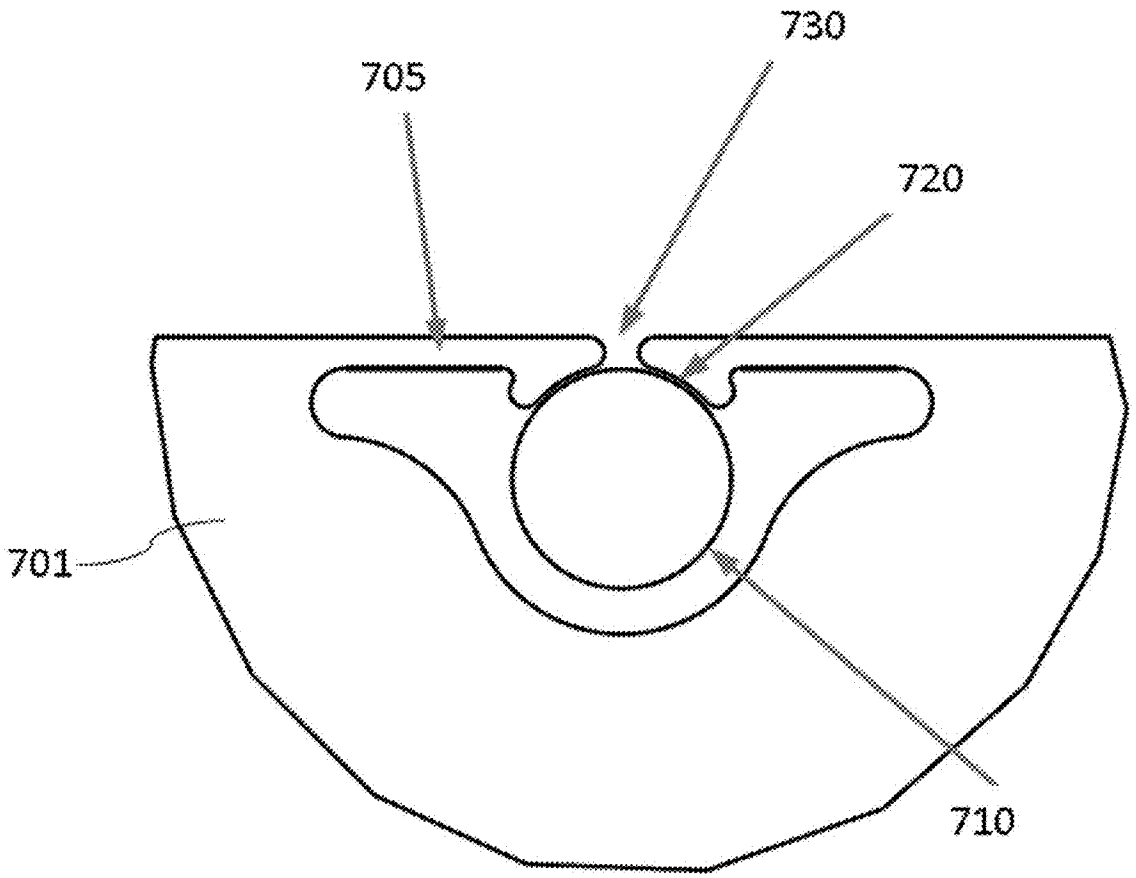
FIG. 7 is an illustration of a rod aperture comprising a flexure suitable for coupling to a rod, in accordance with certain examples.

In certain examples, the exact shape and materials present in the rods can vary. In some embodiments, the rod may be square, circular, elliptical or may take other shapes. Similarly, the exact shape and size of the rod aperture on the planar body may vary. Desirably, the particular shape of the rod can be matched to the particular shape of the rod aperture to permit effective coupling of the rod to the planar body. In some examples, the rod aperture may include suitable features to enhance coupling of the rod to the planar bodies present in the reflectron. For example and referring to FIG. 7, a cross-section of one configuration of a rod aperture in a planar body 701 is shown in more detail. A generally circular rod 710 is inserted in proximity to the flexure 705 of the rod aperture. A drop of adhesive or other bonding material may be added at site 730. The small space or gap 720 acts to wick the adhesive into the space between the rod 710 and the flexure 705 and hold the rod 710 to the flexure 705. Subsequent curing of the adhesive retains the planar body 701 to the rod 710 through the flexure 705. While two flexures are shown in FIG. 7, the rod aperture may include a single flexure, two flexures, three flexures or other suitable features that are effective to couple to the rod.

Figure 8C:
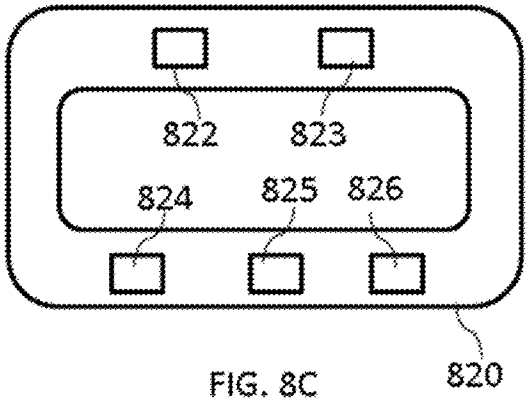
FIGS. 8A-8D are illustrations of planar bodies comprising various rod apertures, in accordance with certain examples.
Figure 8D:
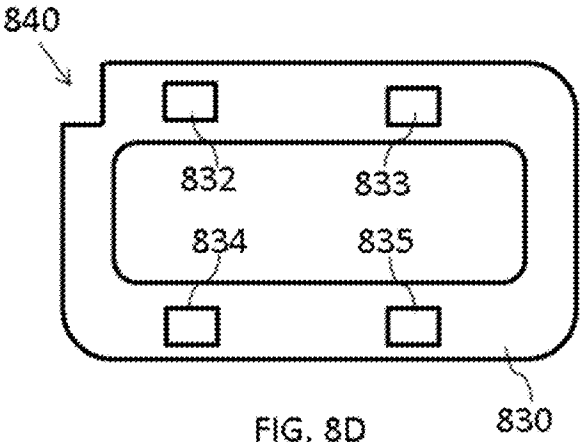
Figure 8A:
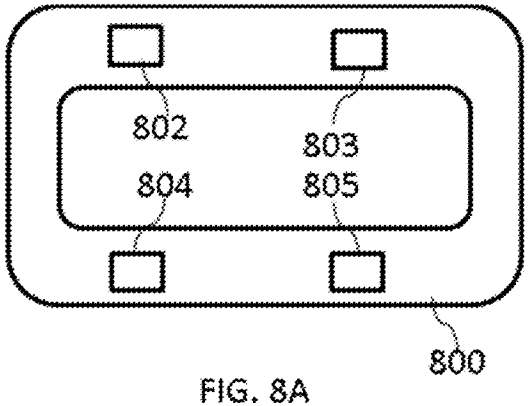
Figure 8B:
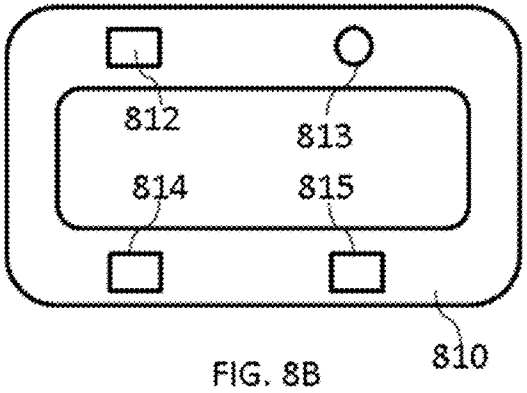

In some embodiments, the rod apertures present on a planar body may positioned in many different manners. Referring to FIG. 8A, a planar body 800 is shown comprising four rod apertures 802, 803, 804 and 805. In the configuration of FIG. 8A, the rod apertures are all generally sized and shaped the same. In some instances, it may be desirable to include one or more different rod apertures such that the planar bodies must be positioned in a desired manner prior to insertion of the rods. For example, the rod apertures may be polarized to provide a visual indicator to permit proper placement of the planar bodies into the assembly jig. Referring to FIG. 8B, a planar body 810 is shown comprising rod apertures 812-815. Rod aperture 813 comprises a different shape than rod apertures 812, 814 and 815 such that each planar body of the reflectron assembly must be positioned similar to the planar body 810 prior to insertion of the rods into the planar bodies. In other configurations, a different number of rod apertures may be present on one side of the planar body. Referring to FIG. 8C, a planar body 820 comprises rod apertures 822, 823 on one side and rod apertures 824-826 on an opposite side of the body 820. The apertures 822, 823 are offset from the apertures 824-826 such that the planar bodies of the reflectron must be positioned similarly to permit insertion of the rods through the rod apertures 822-826. In other configurations, one or more notches or slots may be present on the planar body to guide placement of the planar bodies into the assembly jig. For example and referring to FIG. 8D, a planar body 830 comprises a plurality of rod apertures 832-835 and an alignment cut-out 840. When placing the planar bodies into the assembly jig, the cut-outs can all be positioned on the same side of the jig to provide a visual indicator that the planar bodies are properly inserted into the jig prior to insertion of the rods into the rod apertures 832-835.

In certain examples, the exact materials used in the rods may vary and desirably the rod materials are substantially inert and strong enough to support the lens stack without any substantial bending or distortion. In addition, the materials of the rods may comprise low coefficients of thermal expansion so the overall length of the lens stack is not altered substantially as temperature or pressure varies. Illustrative rod materials include, but are not limited to, stainless steels, ceramics, titanium and titanium alloys, aluminum and aluminum alloys or other suitable materials.

Figure 9:
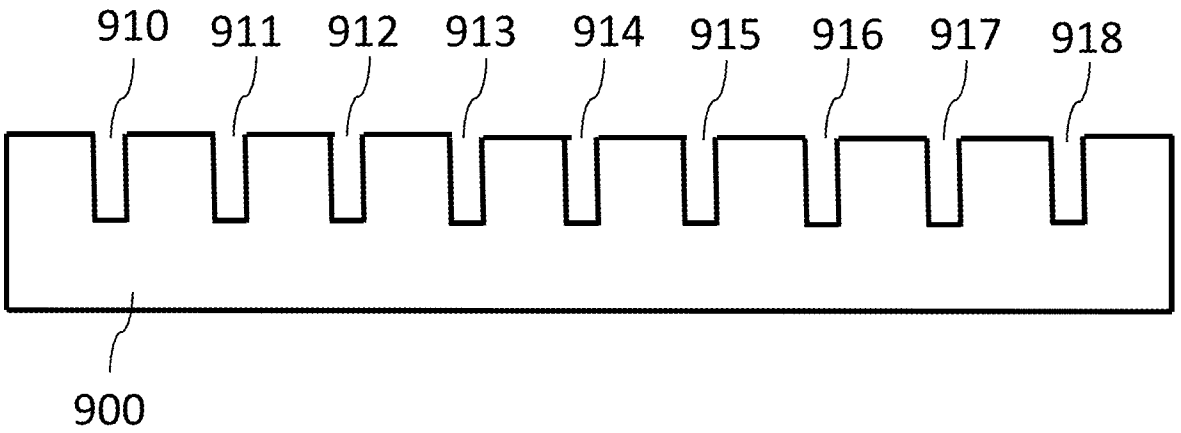
FIG. 9 is an illustration of an assembly jig, in accordance with certain examples.

In some embodiments, during assembly of the reflectron, two or more lenses may be inserted into a jig comprising a plurality of slots or grooves each sized and arranged to receive a single planar body. Referring to FIG. 9, a jig 900 comprises a plurality of slots 910-918. A desired number of lenses can be inserted into the various slots of the jigs 900 prior to insertion of the rods through the rod apertures of the planar bodies. In certain configurations, the slots of the jig are configured to hold the various lenses upright and substantially parallel to each other. After insertion of the desired number of lenses, rods are inserted in a direction orthogonal to the planar surfaces of the lenses and through the rod apertures of the planar bodies (not shown). An adhesive, weld or other attachment methods can be used to couple each rod to each rod aperture of each lens inserted into the jig. After coupling of the rods to the rod apertures, the overall assembly may be lifted out of the jig to provide a reflectron assembly with a plurality of substantially parallel lenses each operative as an ion grid when energized. The distances between the slots, e.g., the spacing between slots 910, 911 or other slots, can be selected to position the planar bodies a desired distance from each other in the reflectron assembly. For example, in some instances, the distance between slots in the jig may be about 0.20 inches to about 0.30 inches, more particularly, about 0.22 inches to about 0.28 inches, e.g., about 0.22-0.23 inches.

Figure 10B:
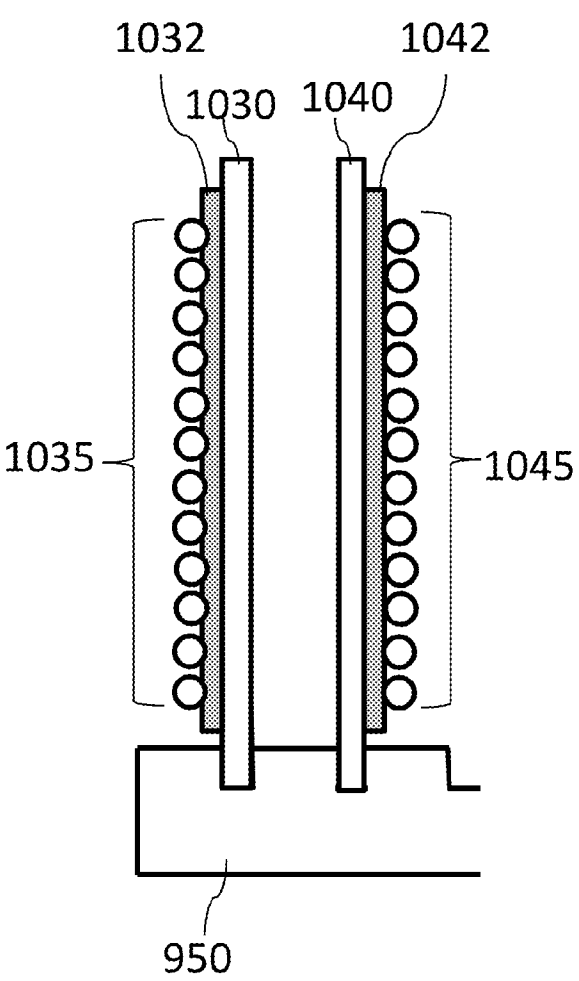
FIGS. 10A and 10B are illustrations of two lenses inserted into an assembly jig, in accordance with certain examples.
Figure 10A:
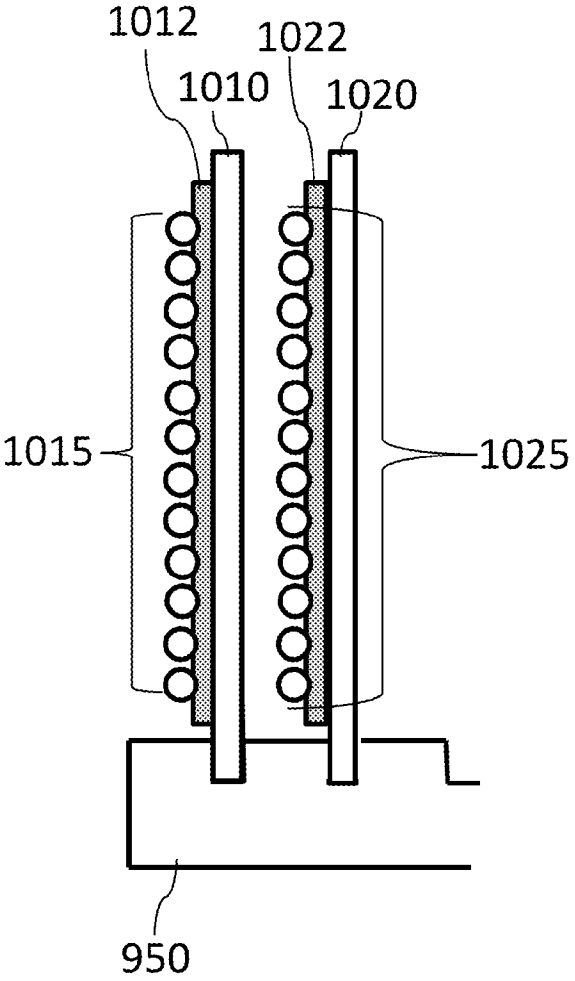

In certain examples, each of the planar bodies can be placed in the jig in the same orientation or in a different orientation. For example and referring to FIG. 10A, an illustration of two planar bodies, each comprising a plurality of individual conductors, placed in an assembly jig 950 is shown. A bottom portion of each of the planar bodies 1010, 1020 is inserted into slots of the jig 950. As shown in FIG. 10A, the planar body 1010 comprises a conductive element 1012 disposed on the planar body 1010 and electrically coupled to a plurality of conductors 1015 on a first surface of the planar body 1010. A second planar body 1020 comprises a conductive element 1022 disposed on the second planar body 1020 and electrically coupled to a plurality of conductors 1025 on a first surface of the second planar body 1020. As shown in FIG. 10A, the conductors 1015 and 1025 are positioned on similar sides or faces of the planar bodies, e.g., on the left side or left face in the view of FIG. 10A. While not shown in FIG. 10A, rods can be inserted through rod apertures of the planar bodies 1010, 1020 to retain the planar bodies 1010, 1020 in the orientation shown in FIG. 10A after the planar bodies 1010, 1020 have been removed from the jig 950.

In other examples, it may be desirable to use the jig to assemble planar bodies where the conductors are positioned on opposite sides of each other. Referring to FIG. 10B, a bottom portion of each of the planar bodies 1030, 1040 is inserted into slots of the jig 950. As shown in FIG. 10B, planar body 1030 comprises a conductive element 1032 disposed on the planar body 1030 and electrically coupled to a plurality of conductors 1035 on a first surface of the planar body 1030. A second planar body 1040 comprises a conductive element 1042 disposed on the second planar body 1040 and electrically coupled to a plurality of conductors 1045 on a second surface of the second planar body 1040. As shown in FIG. 10B, the conductors 1035 and 1045 are positioned on opposite faces of the planar bodies 1030, 1040, respectively. While not shown in FIG. 10B, rods can be inserted through rod apertures of the planar bodies 1030, 1040 to retain the planar bodies 1030, 1040 in the orientation shown in FIG. 10B after the planar bodies 1030, 1040 have been removed from the jig 950. If desired, the jig 950 could be used to couple two planar bodies to rods where the conductors of one planar body are adjacent to the conductors of another planar body. For example, the conductors 1015 in FIG. 10A could be positioned on a second surface adjacent to the first surface of the planar body 1020, and then the planar bodies can be coupled to each other through rods to provide a lens stack.

Figure 11:
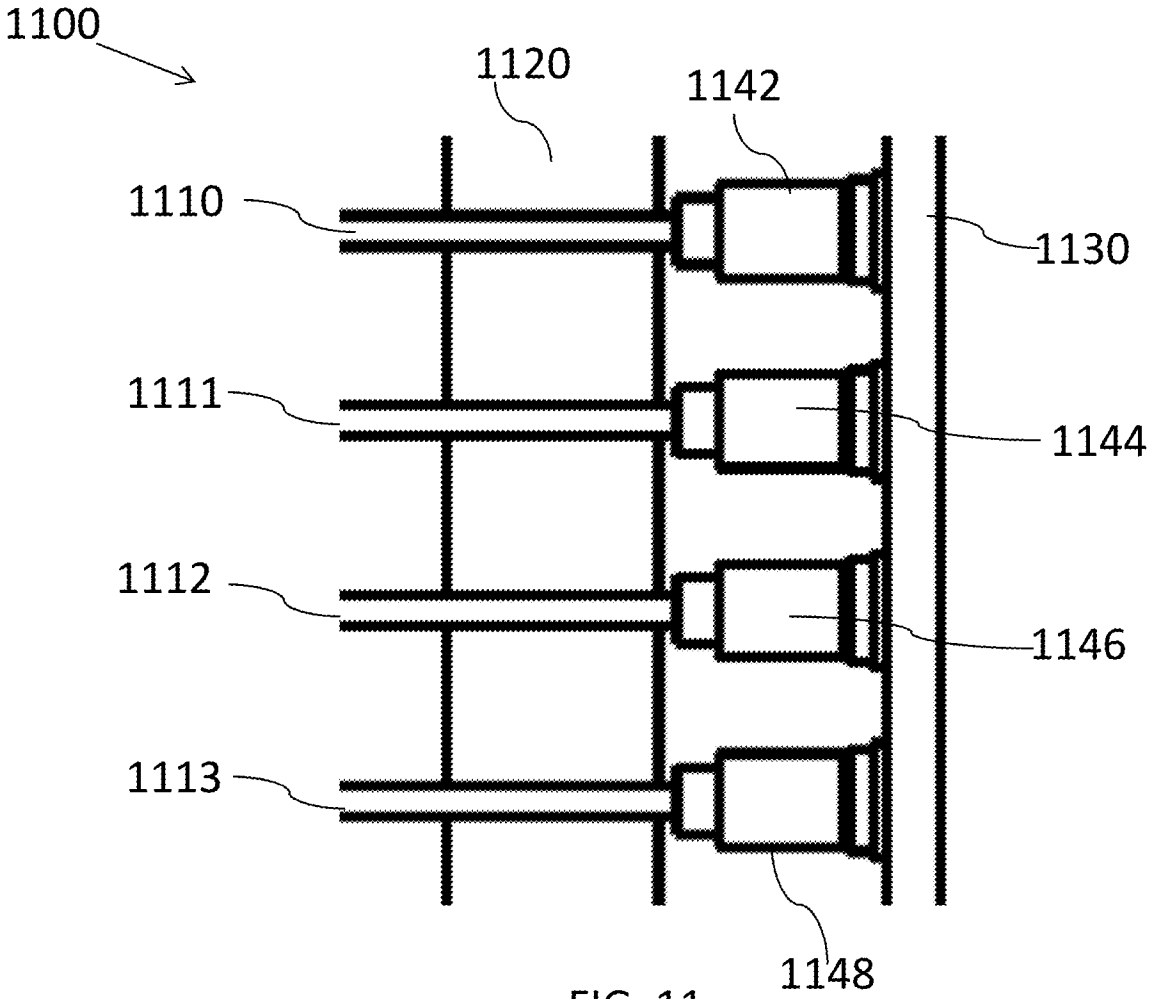
FIG. 11 is an illustration of a printed circuit board assembly comprising spring contacts electrically coupled to a plurality of lenses, in accordance with certain examples.

In certain embodiments, a method of deceleration used by the reflectron is that of a decreasing voltage over the planar body stack. This decreasing voltage can be facilitated by a resistor network attached to each planar body or lens. In order to maintain the parallelism of each of the lenses of the reflectron, a contact load along the thin edge of the planar body can be applied instead of contacting the lens on a face of the planar body. In one example, voltage distribution can be provided by way of a conductive board, e.g., a printed circuit board (PCB), with spring loaded contacts pins (pogo pins). Referring to FIG. 11, a reflectron assembly 1100 comprises a plurality of lenses 1110-1113. A rod 1120 is shown as being positioned through rod apertures (not shown) of the lenses 1110-1113. A PCB 1130 is electrically coupled to a plurality of spring contacts 1142, 1144, 1146 and 1148. After assembly, the PCB rests on one side of the lens stack. Each of the spring contacts is configured to engage an edge of a single lens to provide power to that lens. By contacting an edge of the lens instead of a face of the lens, minimal or no distortion of the lens occurs, which keeps the various lenses parallel to each other in the reflectron assembly. In certain embodiments, the exact voltage applied to any one of the lenses may vary. For example, a first lens near the entrance of the reflectron may comprise a voltage of about −700 Volts and the voltage may decrease down the lens stack. Depending on the exact configuration of the reflectron, e.g., whether it is a single-stage or double-stage reflectron, the differences in voltage of different lenses may vary. In addition, while a single PCB is shown in FIG. 11, if desired, two or more PCBs may be present with different resistor ladders to alter the voltage of the lenses. For example, a first PCB may rest on one face of the lens stack and a second, different PCB may rest on a different face of the lens stack.

In certain examples, the PCB may couple to the lens stack using clipless methods. For example, in many existing reflectron configurations, binder clips or other clips that clamp to the surfaces of the lenses are used to electrically couple the power source to the lenses. In embodiments of the reflectrons described herein, such clips can distort the planar bodies and render them non-parallel to each other. By electrically coupling the PCB in a clipless manner, distortion of the lenses can be avoided. In some examples, the spring contacts used herein may be compression springs that can be adjusted to apply minimal force on the lenses while maintaining contact with the edge of the lenses.

Figure 12:
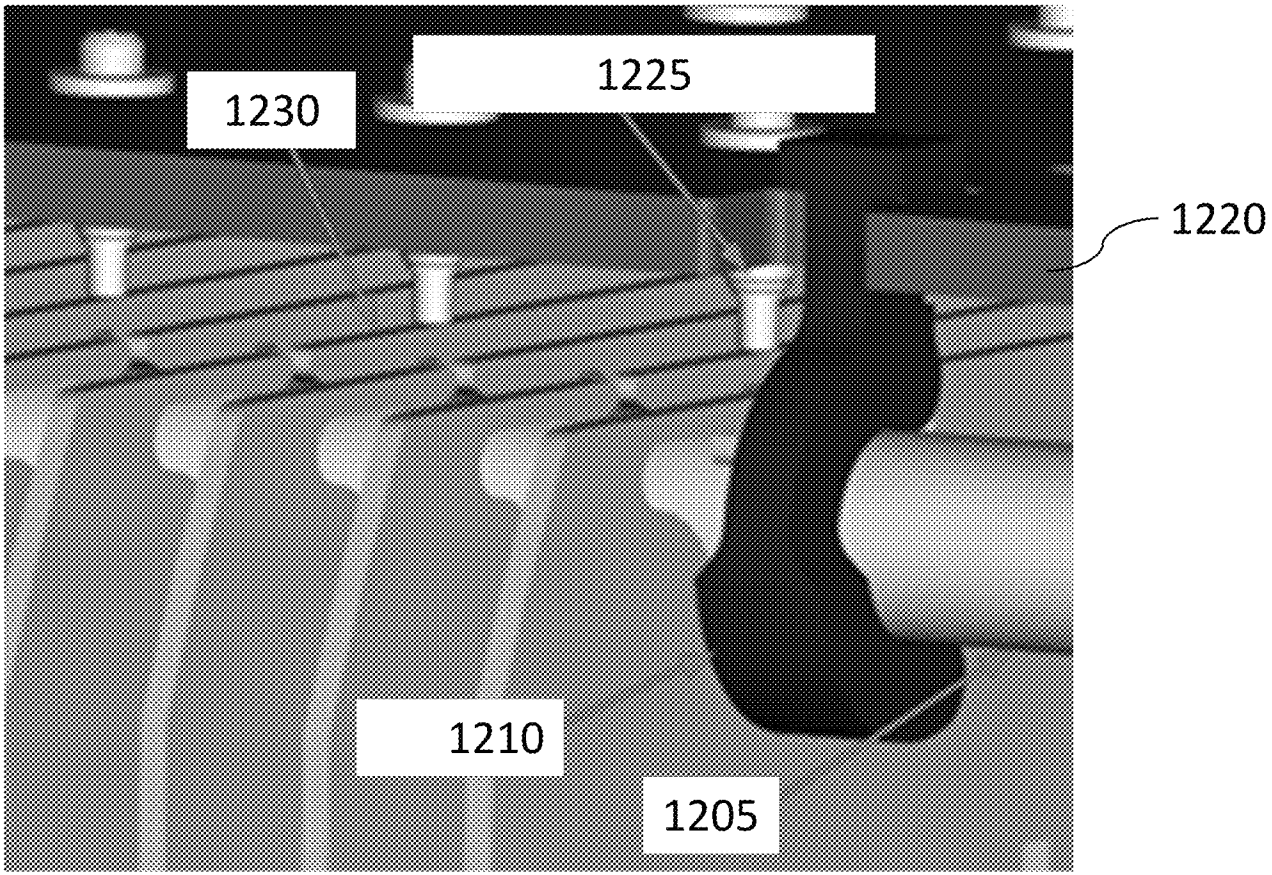
FIG. 12 is an illustration of a clamp used to couple a conductive board to a reflectron assembly, in accordance with certain examples.

In some embodiments, the PCB can be coupled to the reflectron lenses by coupling the PCB to the rods inserted through the lenses. For example and referring to FIG. 12, a clamp 1210 is coupled to a rod 1205 and the PCB 1220. By coupling the clamp 1210 to the rod 1205 of the reflectron assembly instead of the lenses, the lenses will not become distorted or non-parallel to each other. As noted in connection with FIG. 11, the PCB 1220 may include a respective spring contact 1225 for each lens of the reflectron assembly. For example, a spring contact may contact the edge of the face of lens 1230 to provide voltage to the lens 1230. While the exact number of clamps can vary depending on the number of rods, in some embodiments, at least two clamps per rod are present in the reflectron. Depending on the length of the reflectron assembly, it may be desirable to use fewer or more than two clamps per rod. In some instances where one surface of the assembly includes three or more rods, it may be desirable to clamp the PCB to the outer rods and no clamp may be present between the middle rod and the PCB. While clamps are shown as being used to couple the rods to the PCB, other fasteners such as loops, hooks, pin and holes, etc. may also be used to couple the PCB to the rods of the reflectron assembly.

Figure 13:
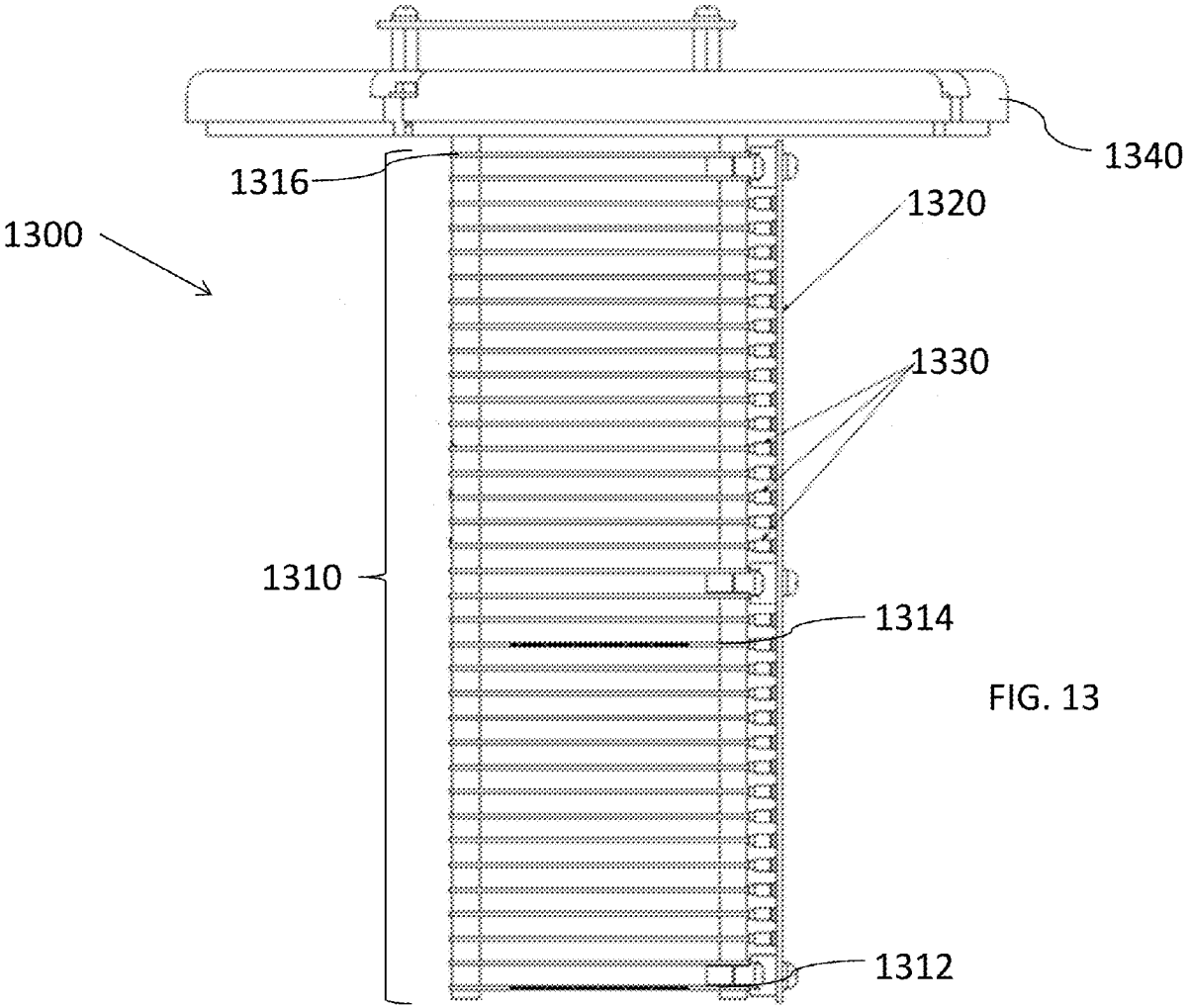
FIG. 13 is an illustration of a reflectron assembly coupled to a mounting surface, in accordance with certain examples.

In certain examples, the PCB may include a respective number of spring contacts as the number of lenses present in the reflectron. An overall schematic of a reflectron assembly is shown in FIG. 13. The assembly 1300 comprises a plurality of lenses 1310 positioned substantially parallel to each other and coupled to transverse rods (not shown) which run orthogonal to the planar, flat surfaces of the lenses 1310. A printed circuit board 1320 runs the longitudinal length of the lens stack 1310 and comprises a plurality of spring contacts, such as springs contacts 1330, each configured to physically contact the edge of a lens and electrically couple to the contacted lens to a power source. The reflectron assembly may be coupled to a mounting plate 1340, which may include a power source (not shown) on it to provide power to the PCB 1320 and any other components of the assembly 1300 or an instrument that comprises the assembly 1300. The mounting plate 1340 may be configured to receive an O-ring or gasket (not shown) on an under surface so that when the reflectron assembly is inserted into a time of flight tube, the reflectron assembly is sealed in the tube and a vacuum can be maintained in the time of flight tube. In the configuration shown in FIG. 13, lenses 1312 and 1314 comprise conductors spanning the apertures of those lenses, while no conductors are present on the other lenses of the lens stack 1310. If desired, however, less than two lenses comprising conductors or more than two lenses comprising conductors may be present in the lens stack 1310. A terminal lens 1316 generally does not comprise an aperture and is effective as an ion mirror.

Figure 14:
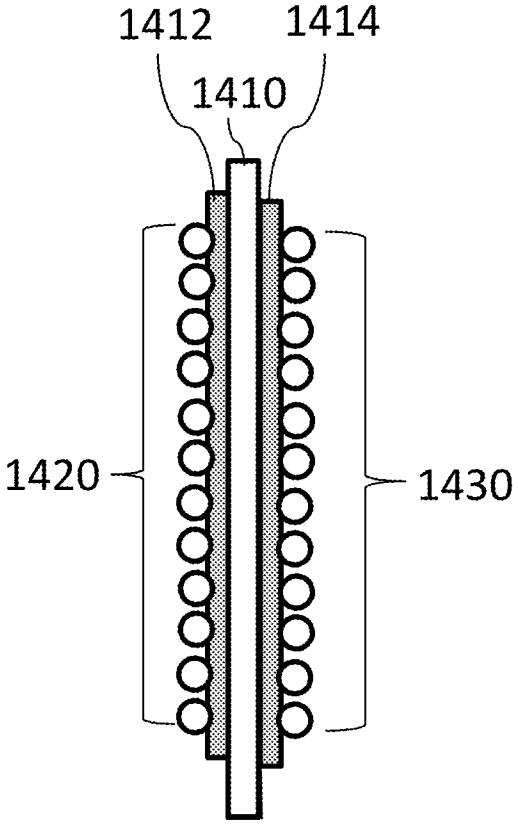
FIG. 14 is a side view of a lens comprising a plurality of individual conductors disposed on each surface of a planar body, in accordance with certain examples.

In certain embodiments, if desired the lenses described herein may include a plurality of individual conductors on each side of the planar body. A side view of such a configuration is shown in FIG. 14. The lens 1400 comprises a planar body 1410 with an aperture (not shown in the side view of FIG. 14). On each side of each surface of the planar body 1410, a pair of conductive elements is disposed, similar to the conductive elements 325, 327 shown in FIG. 3. For example, at one side of a first surface of the planar body 1410 a conductive element 1412 is present, and on one side of a second surface of the planar body 1410 another conductive element 1414 is disposed. A first set of conductors 1420 is disposed on the first surface and contacts the conductive element 1412, and a second set of conductors 1430 is disposed on the first surface and contacts the conductive element 1414. Each conductor of the first set of conductors 1420 is generally parallel to each of the other conductors of the first set 1420 and is a separate and individual conductor. Similarly, each conductor of the second set of conductors 1430 is generally parallel to each of the other conductors of the second set 1430 and is a separate and individual conductor. By including conductors on each surface of the planar body, thinner planar bodies and smaller diameter conductors can be used while still achieving desirable performance.

Figure 15:
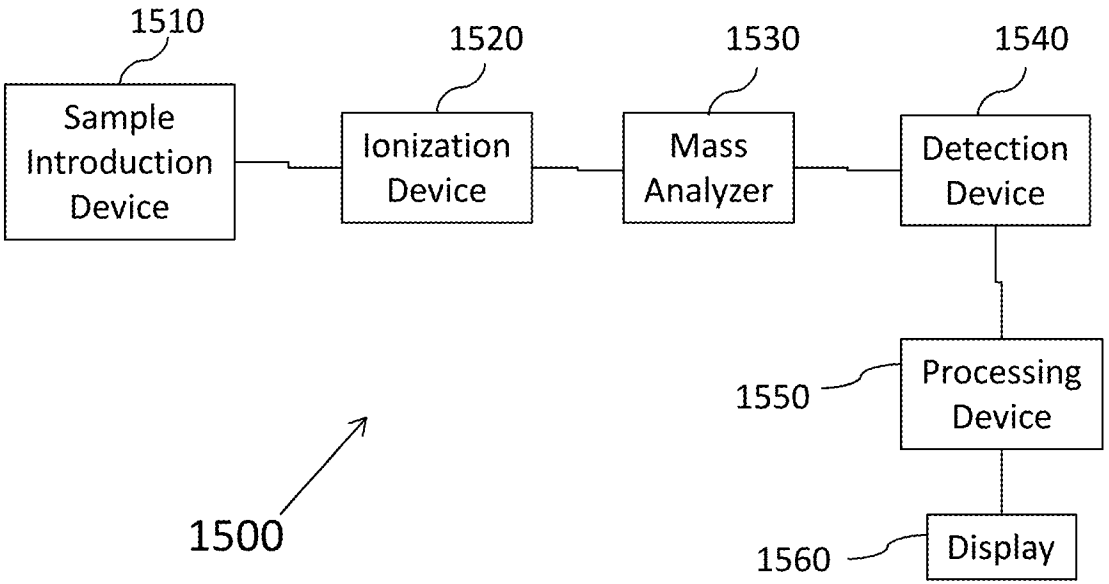
FIG. 15 is a block diagram of a mass spectrometer, in accordance with certain examples.

In certain embodiments, the reflectrons described herein can be used in a mass spectrometer. An illustrative MS device is shown in FIG. 15. The MS device 1500 includes a sample introduction device 1510, an ionization device 1520, a mass analyzer 1530, a detection device 1540, a processing device 1550 and a display 1560. The sample introduction device 1510, ionization device 1520, the mass analyzer 1530 and the detection device 1540 may be operated at reduced pressures using one or more vacuum pumps. In certain examples, however, only the mass analyzer 1530 and the detection device 1540 may be operated at reduced pressures. The sample introduction device 1510 may include an inlet system configured to provide sample to the ionization device 1520. The inlet system may include one or more batch inlets, direct probe inlets and/or chromatographic inlets. The sample introduction device 1510 may be an injector, a nebulizer or other suitable devices that may deliver solid, liquid or gaseous samples to the ionization device 1520. The ionization device 1520 may be any one or more ionization devices commonly used in mass spectrometer, e.g., may be any one or more of the devices which can atomize and/or ionize a sample including, for example, plasma (inductively coupled plasmas, capacitively coupled plasmas, microwave-induced plasmas, etc.), arcs, sparks, drift ion devices, devices that can ionize a sample using gas-phase ionization (electron ionization, chemical ionization, desorption chemical ionization, negative-ion chemical ionization), field desorption devices, field ionization devices, fast atom bombardment devices, secondary ion mass spectrometry devices, electrospray ionization devices, probe electrospray ionization devices, sonic spray ionization devices, atmospheric pressure chemical ionization devices, atmospheric pressure photoionization devices, atmospheric pressure laser ionization devices, matrix assisted laser desorption ionization devices, aerosol laser desorption ionization devices, surface-enhanced laser desorption ionization devices, glow discharges, resonant ionization, thermal ionization, thermospray ionization, radioactive ionization, ion-attachment ionization, liquid metal ion devices, laser ablation electrospray ionization, or combinations of any two or more of these illustrative ionization devices. The mass analyzer 1530 may take numerous forms depending generally on the sample nature, desired resolution, etc., and exemplary mass analyzers include the reflectrons described herein. The detection device 1540 may be any suitable detection device that may be used with existing mass spectrometers, e.g., electron multipliers, Faraday cups, coated photographic plates, scintillation detectors, etc., and other suitable devices that will be selected by the person of ordinary skill in the art, given the benefit of this disclosure. The processing device 1550 typically includes a microprocessor and/or computer and suitable software for analysis of samples introduced into MS device 1500. One or more databases may be accessed by the processing device 1550 for determination of the chemical identity of species introduced into MS device 1500. Other suitable additional devices known in the art may also be used with the MS device 1500 including, but not limited to, autosamplers, such as AS-90plus and AS-93plus autosamplers commercially available from PerkinElmer Health Sciences, Inc.

In certain embodiments, the mass analyzer 1530 of the MS device 1500 may take numerous forms depending on the desired resolution and the nature of the introduced sample. In certain examples, the mass analyzer is a scanning mass analyzer, a magnetic sector analyzer (e.g., for use in single and double-focusing MS devices), a quadrupole mass analyzer, an ion trap analyzer (e.g., cyclotrons, quadrupole ions traps), time-of-flight analyzers (e.g., matrix-assisted laser desorbed ionization time of flight analyzers), and other suitable mass analyzers that may separate species with different mass-to-charge ratios. In some embodiment, two stages may be included where one stage comprises a reflectron as described herein.

In some examples, the MS devices disclosed herein may be hyphenated with one or more other analytical techniques. For example, MS devices may be hyphenated with devices for performing liquid chromatography, gas chromatography, capillary electrophoresis, and other suitable separation techniques. When coupling an MS device with a gas chromatograph, it may be desirable to include a suitable interface, e.g., traps, jet separators, etc., to introduce sample into the MS device from the gas chromatograph. When coupling an MS device to a liquid chromatograph, it may also be desirable to include a suitable interface to account for the differences in volume used in liquid chromatography and mass spectroscopy. For example, split interfaces may be used so that only a small amount of sample exiting the liquid chromatograph may be introduced into the MS device. Sample exiting from the liquid chromatograph may also be deposited in suitable wires, cups or chambers for transport to the ionization devices of the MS device. In certain examples, the liquid chromatograph may include a thermospray configured to vaporize and aerosolize sample as it passes through a heated capillary tube. Other suitable devices for introducing liquid samples from a liquid chromatograph into a MS device will be readily selected by the person of ordinary skill in the art, given the benefit of this disclosure. In certain examples, MS devices can be hyphenated with each other for tandem mass spectroscopy analyses.

In certain embodiments, the lenses described herein may be present in the form of a kit which can be used to assemble a reflectron. For example, the kit may include a plurality of lenses, a jig assembly configured to receive the lenses and instructions for using the jig and the lenses to assemble a reflectron. In some instances, the kit may also include rods that can be used to couple to the lenses to provide a reflectron assembly. In other configurations, the kit may include a conductive adhesive that can be used to couple the rods to the lenses. In additional configurations, the kit may include a conductive board, e.g., a printed circuit board that can be provide electrical coupling between a power source and each lens of the lens stack of the reflectron.

In certain examples, a method of assembling a reflectron comprises inserting a plurality of ion lenses into an assembly jig comprising a plurality of slots each sized and arranged to receive a single ion lens and position the ion lens substantially parallel to each other. The method may also include inserting at least one transverse rod through rod apertures in each of the inserted ion lenses in the assembly jig. The method may further include coupling the inserted transverse rod to each of the inserted ion lenses is provided. In certain embodiments, the coupling step comprises coupling the transverse rod to each lens using a conductive adhesive. In other embodiments, the method comprises removing the coupled transverse rod and plurality of ions lenses from the assembly jig. In additional embodiments, the method comprises inserting a respective transverse rod through each rod aperture of the ion lenses to couple the rods to the ion lenses. In some examples, the coupling step comprises coupling each transverse rod to each lens using a conductive adhesive. In other examples, the method comprises coupling a conductive board to the coupled lens/rod assembly. In further examples, the method comprises coupling the conductive board by clamping the conductive board to at least one transverse rod. In some embodiments, the step of the coupling the conductive board comprises clamping the conductive board to a transverse rod at two different sites. In other embodiments, the step of the coupling the conductive board comprises clamping the conductive board to at least two different transverse rods.

Certain specific examples are described below to facilitate a better understanding of the technology described herein.

Example 1

Figure 16:
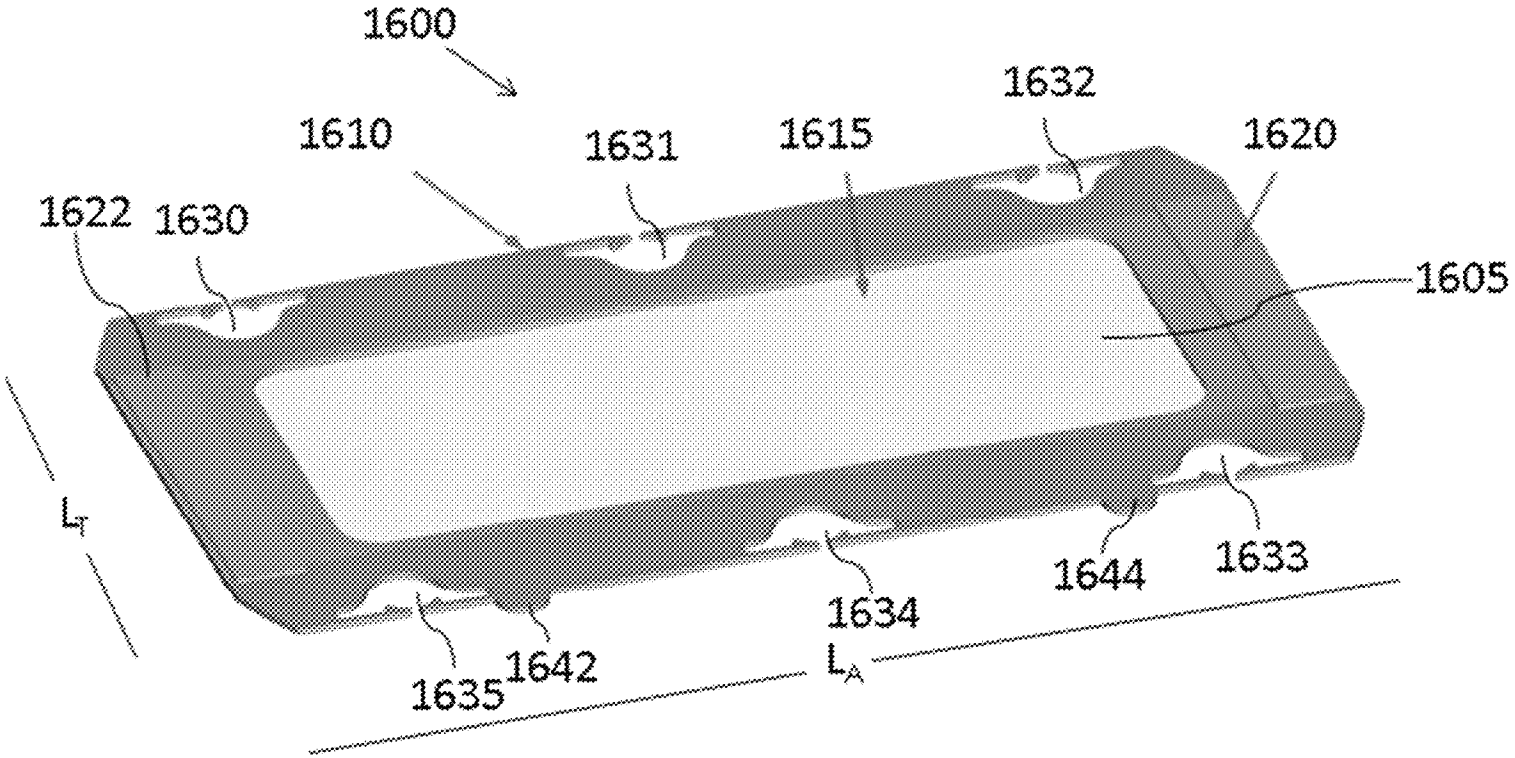
FIG. 16 is an illustration of lens, in accordance with certain examples.

Referring now to FIG. 16, a lens 1600 comprises a planar body 1610 and a central aperture 1605. A plurality of individual conductors or wires 1615 are positioned substantially parallel to the longitudinal axis $L_A$ of the plate 1600. The conductors of the lens 1600 are generally parallel to each other along the direction of the longitudinal axis $L_A$. In some embodiments, only conductors that are substantially parallel to the longitudinal axis $L_A$ are included on the lens 1600. For example, the lens is configured without transverse wires or conductors, e.g., conductors substantially orthogonal to the longitudinal wires or generally parallel to the transverse axis $L_T$ are not present, which may be present in a mesh or etched conductors commonly found in existing reflectrons. In some embodiments, for a selected lens, substantially all conductors of the lens are parallel to each other. The wires or conductors of the lens 1600 can be bonded, adhered or otherwise attached to a conductive pad or element 1620 (or conductive element or pad 1622 or both) positioned on the lens 1600 to permit current to flow from the plate to the pad 1620 and to conductors 1615. The lens 1600 may be produced by disposing the conductors across one face of the planar body of the lens 1600, e.g., on one side of the lens 1600, and attaching the conductors to the conductive elements 1620, 1622 using an adhesive, welding or other suitable attachment means. The exact spacing between conductors can vary and illustrative spacings include, but are not limited to, about 0.002-0.008 inches where the conductors are about 0.001-0.002 inches in width. The material of the conductors may be the same or may be different and illustrative materials include inert conductive materials or other suitable materials, e.g., tungsten, gold, tungsten wire, gold wire, or other suitable materials.

A plurality of rod apertures 1630-1635 are present and configured to couple to rods to hold the lens 1600 in a desired position in a lens stack. Alignment tabs 1642 and 1644 are present on the planar body 1610 to permit insertion of the lens into a jig in a single orientation.

Example 2

Figure 17:
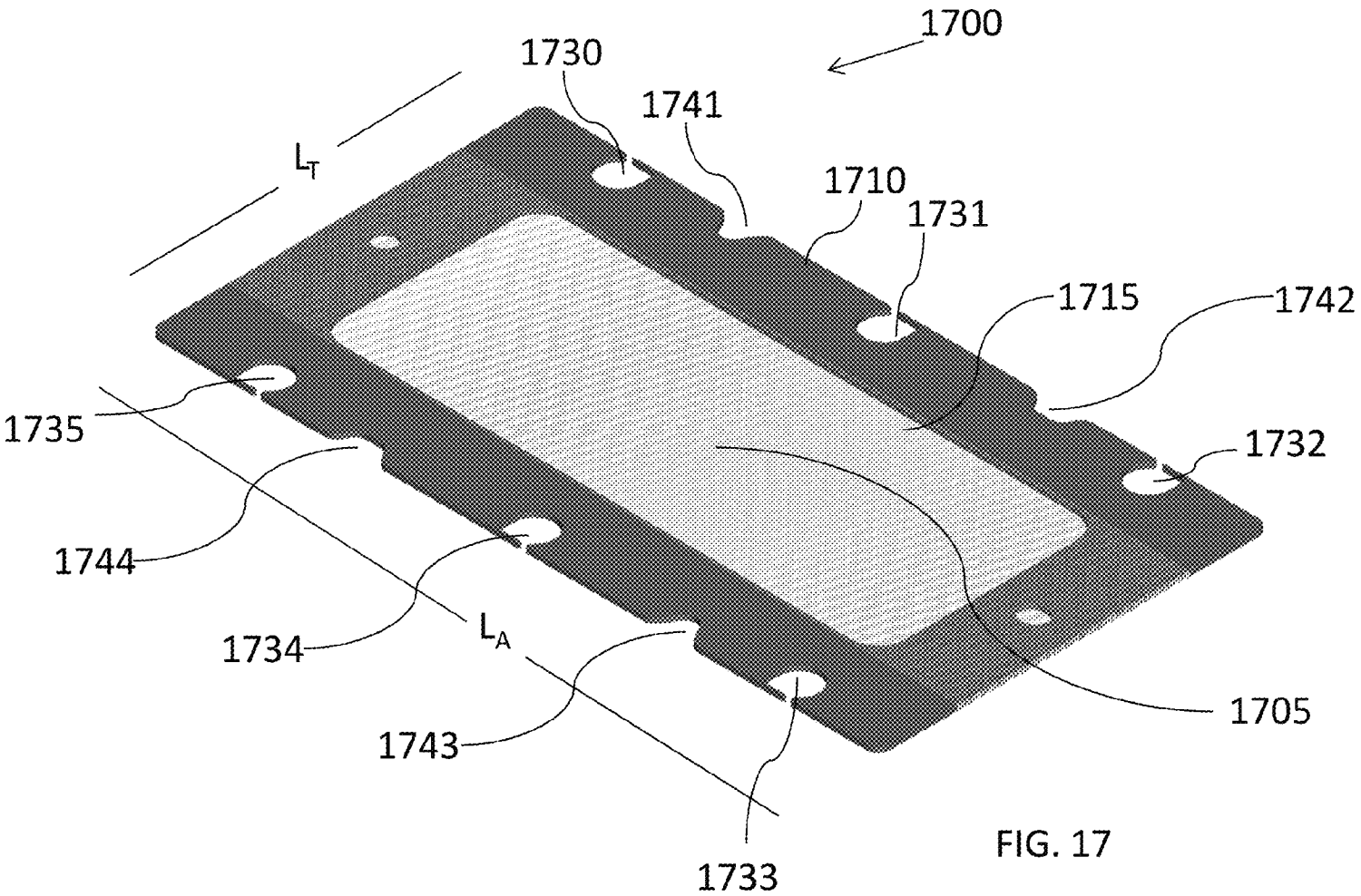
FIG. 17 is another illustration of lens, in accordance with certain examples.

Referring now to FIG. 17, a lens 1700 comprises a planar body 1710 and a central aperture 1705. A plurality of individual conductors or wires 1715 are positioned substantially parallel to the longitudinal axis of the lens 1700. The conductors of the lens 1700 are generally parallel to each other along the direction of the longitudinal axis $L_A$. In some embodiments, only conductors that are substantially parallel to the longitudinal axis $L_A$ are included on the lens 1700. For example, the lens is configured without transverse wires or conductors, e.g., conductors substantially orthogonal to the longitudinal wires or generally parallel to the transverse axis $L_T$ are not present, which may be present in a mesh or etched conductors commonly found in existing reflectrons. In some embodiments, for a selected lens, substantially all conductors of the lens are parallel to each other. The wires or conductors of the lens 1700 can be bonded, adhered or otherwise attached directly to the planar body 1710 without the use of a conductive pad or element to permit current to flow from the body 1710 and to the conductors 1715. The lens 1700 may be produced by disposing the conductors across one face of the planar body of the lens 1700, e.g., on one side of the lens 1700, and attaching the conductors to the planar body 1710 using an adhesive, welding or other suitable attachment means. The exact spacing between conductors can vary and illustrative spacings include, but are not limited to, about 0.002-0.008 inches where the conductors are about 0.001-0.002 inches in width. The material of the conductors may be the same or may be different and illustrative materials include inert conductive materials or other suitable materials, e.g., tungsten wire, gold-plated wire or other suitable materials.

A plurality of rod apertures 1730-1735 are present and configured to couple to rods to hold the lens 1700 in a desired position in a lens stack. Alignment grooves 1741-1744 are present on the planar body 1710 to permit insertion of the lens into a jig in a single orientation. In the configuration shown in FIG. 17, alignment grooves 1741 and 1743 are sized and arranged to be substantially the same, and alignment grooves 1742 and 1744 are sized and arranged to be substantially the same. If desired, however, the alignment grooves may be polarized such that the lens 1700 can be inserted into a jig in only a single orientation.

Example 3

Figure 18:
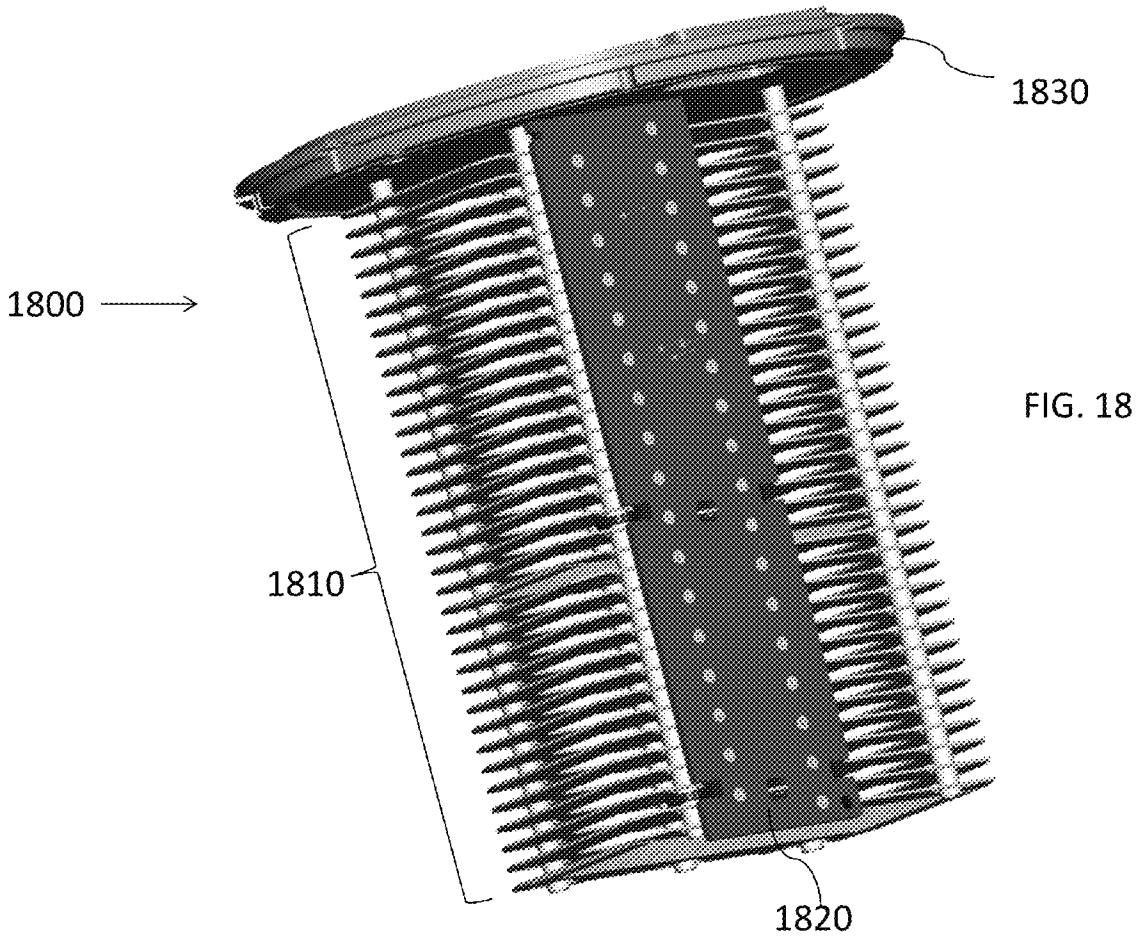
FIG. 18 is an illustration of a reflectron assembly, in accordance with certain examples.

Referring to FIG. 18, a reflectron assembly 1800 is shown that comprises a plurality of aligned lenses in a lens stack 1810 which are coupled to each other through a plurality of rods. A conductive board 1820 is coupled to the lens stack 1810 through spring contacts which are arranged in two columns and alternate connections between the lenses of the lens stack. For example, a first contact near a mounting plate 1830 is positioned in a right column and contacts the first plate adjacent to the mounting plate 1830. The next contact is in the left column and contacts the second plate down the lens stack 1810 from the top of the lens stack near the mounting plate 1830. This alternating configuration continues down the length of the lens stack 1810 until each lens of the stack 1810 is electrically coupled to the conductive board 1820 through a respective spring contact. As described herein, the contacts sit against an edge of the lenses rather than a face to avoid distortion or undue strain on the lenses which may alter the lens parallelism.

When introducing elements of the examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

The invention claimed is:

1. A reflectron comprising:

a plurality of lenses, in which at least a first lens comprises a first planar body comprising a first surface and a second surface, the first planar body comprising an aperture between a first side and a second side of the first surface of the first planar body, the first planar body further comprising a plurality of separate and individual conductors spanning the aperture from the first side to the second side of the first surface of the first planar body, each of the plurality of conductors attached to the first surface of the first planar body at the first side and at the second side of the first surface, in which the plurality of individual conductors are each substantially parallel to each other and are positioned in the same plane, in which the first planar body further comprises a conductive element disposed on the first surface of the first planar body and in contact with each of the plurality of conductors to permit current flow from the planar body to the plurality of conductors; and a plurality of transverse rods coupled to each of the plurality of lenses and effective to retain the plurality of lenses substantially parallel to each other.

2. The reflectron of claim 1, in which at least two of the plurality of planar bodies of the plurality of lenses is configured the same as the first planar body.

3. The reflectron of claim 1, in which the plurality of conductors do not contact the second surface of the planar body.

4. The reflectron of claim 3, in which the plurality of conductors are all positioned in the same plane.

5. The reflectron of claim 1, in which each of the plurality of conductors comprises tungsten wires.

6. The reflectron of claim 1, in which each of the plurality of conductors is the same material.

7. The reflectron of claim 1, in which the plurality of conductors attach to the conductive element through a conductive adhesive.

8. The reflectron of claim 1, in which the transverse rods are each ceramic rods.

9. The reflectron of claim 8, in which each planar body comprises a plurality of flexures configured to couple to one of the transverse rods.

10. The reflectron of claim 9, in which the flexures couple to the transverse rods through a conductive adhesive.

11. The reflectron of claim 1, further comprising a conductive board electrically coupled to each of the plurality of lenses, in which the conductive board is configured to electrically couple to a power source to provide power to each of the plurality of lenses.

12. The reflectron of claim 11, in which the conductive board comprises a resistor network to provide a differential voltage to each of the plurality of lenses.

13. The reflectron of claim 11, in which the conductive board comprises a plurality of spring contacts, in which each lens of the plurality of lenses is electrically coupled to the conductive board through a single spring contact of the plurality of spring contacts.

14. The reflectron of claim 13, in which the conductive board is coupled to the transverse rods through a fastener.

15. The reflectron of claim 14, in which the fastener comprises a clamp coupled to the rod and the conductive board.

16. The reflectron of claim 14, in which the conductive board is configured as a printed circuit board.

17. The reflectron of claim 16, in which the plurality of conductors do not contact the second surface of the planar body.

18. The reflectron of claim 17, in which the plurality of conductors are all positioned in the same plane.

19. The reflectron of claim 18, in which the plurality of conductors attach to the conductive element through a conductive adhesive.

20. The reflectron of claim 19, in which each planar body comprises a plurality of flexures configured to couple to one of the transverse rods.

21. The reflectron of claim 1, in which there are no conductors on the first planar body that are positioned substantially orthogonal to the plurality of conductors.

* * * * *